US007590531B2

(12) United States Patent
Khalil et al.

(10) Patent No.: US 7,590,531 B2
(45) Date of Patent: Sep. 15, 2009

(54) ROBUST DECODER

(75) Inventors: Hosam A. Khalil, Redmond, WA (US); Tian Wang, Redmond, WA (US); Kazuhito Koishida, Redmond, WA (US); Xiaoqin Sun, Redmond, WA (US); Wei-Ge Chen, Issaquah, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 11/197,792

(22) Filed: Aug. 4, 2005

(65) Prior Publication Data

US 2006/0271359 A1 Nov. 30, 2006

Related U.S. Application Data

(63) Continuation of application No. 11/142,602, filed on May 31, 2005.

(51) Int. Cl.
*G10L 21/02* (2006.01)

(52) U.S. Cl. ..... 704/228; 704/226; 704/503

(58) Field of Classification Search ..... 704/267, 704/228, 229, 270, 201, 202, 206, 210, 219, 704/222, 223, 221, 226, 200, 500, 501, 503, 704/504, 207; 370/230.1
See application file for complete search history.

(56) References Cited

U.S. PATENT DOCUMENTS

| | | | |
|---|---|---|---|
| 4,815,134 | A | 3/1989 | Picone et al. |
| 4,969,192 | A | 11/1990 | Chen et al. |
| 5,255,399 | A | 10/1993 | Fette et al. |
| 5,394,473 | A | 2/1995 | Davidson |
| 5,615,298 | A | 3/1997 | Chen |
| 5,664,051 | A | 9/1997 | Hardwick et al. |
| 5,664,055 | A | 9/1997 | Kroon |
| 5,668,925 | A | 9/1997 | Rothweiler et al. |
| 5,699,477 | A | 12/1997 | McCree |
| 5,699,485 | A | 12/1997 | Shoham |
| 5,717,823 | A | 2/1998 | Kleijn |
| 5,724,433 | A | 3/1998 | Engebretson et al. |

(Continued)

FOREIGN PATENT DOCUMENTS

| | | |
|---|---|---|
| CA | 1336454 | 7/1995 |

(Continued)

OTHER PUBLICATIONS

ITU-T, "ITU-T Recommendation G.722, General Aspects of Digital Transmission Systems— Terminal Equipments 7 kHz Audio— Coding within 64 kbit/s," 75 pp. (1988).

(Continued)

*Primary Examiner*—Huyen X. Vo
(74) *Attorney, Agent, or Firm*—Klarquist Sparkman LLP

(57) ABSTRACT

Techniques and tools related to delayed or lost coded audio information are described. For example, a concealment technique for one or more missing frames is selected based on one or more factors that include a classification of each of one or more available frames near the one or more missing frames. As another example, information from a concealment signal is used to produce substitute information that is relied on in decoding a subsequent frame. As yet another example, a data structure having nodes corresponding to received packet delays is used to determine a desired decoder packet delay value.

19 Claims, 12 Drawing Sheets

U.S. PATENT DOCUMENTS

| | | | |
|---|---|---|---|
| 5,734,789 | A | 3/1998 | Swaminathan et al. |
| 5,737,484 | A | 4/1998 | Ozawa |
| 5,751,903 | A | 5/1998 | Swaminathan et al. |
| 5,778,335 | A | 7/1998 | Ubale et al. |
| 5,819,212 | A | 10/1998 | Matsumoto et al. |
| 5,819,298 | A | 10/1998 | Wong et al. |
| 5,835,495 | A | 11/1998 | Ferriere |
| 5,845,244 | A | 12/1998 | Proust |
| 5,870,412 | A | 2/1999 | Schuster et al. |
| 5,873,060 | A | 2/1999 | Ozawa |
| 5,890,108 | A | 3/1999 | Yeldener |
| 6,009,122 | A | 12/1999 | Chow |
| 6,029,126 | A | 2/2000 | Malvar |
| 6,041,345 | A | 3/2000 | Levi et al. |
| 6,064,962 | A | 5/2000 | Oshikiri et al. |
| 6,108,626 | A | 8/2000 | Cellario et al. |
| 6,122,607 | A | 9/2000 | Ekudden et al. |
| 6,128,349 | A | 10/2000 | Chow |
| 6,134,518 | A | 10/2000 | Cohen et al. |
| 6,199,037 | B1 | 3/2001 | Hardwick |
| 6,202,045 | B1 | 3/2001 | Ojala et al. |
| 6,226,606 | B1 | 5/2001 | Acero |
| 6,240,387 | B1 | 5/2001 | DeJaco |
| 6,263,312 | B1 | 7/2001 | Kolesnik et al. |
| 6,289,297 | B1 | 9/2001 | Bahl |
| 6,292,834 | B1 | 9/2001 | Ravi et al. |
| 6,310,915 | B1 | 10/2001 | Wells et al. |
| 6,311,154 | B1 | 10/2001 | Gersho et al. |
| 6,317,714 | B1 | 11/2001 | Del Castillo |
| 6,330,533 | B2 | 12/2001 | Su et al. |
| 6,351,730 | B2 | 2/2002 | Chen |
| 6,385,573 | B1 | 5/2002 | Gao et al. |
| 6,392,705 | B1 | 5/2002 | Chaddha |
| 6,408,033 | B1 | 6/2002 | Chow et al. |
| 6,438,136 | B1 | 8/2002 | Bahl |
| 6,460,153 | B1 | 10/2002 | Chou et al. |
| 6,493,665 | B1 | 12/2002 | Su et al. |
| 6,499,060 | B1 | 12/2002 | Wang et al. |
| 6,505,152 | B1 | 1/2003 | Acero |
| 6,564,183 | B1 | 5/2003 | Hagen et al. |
| 6,614,370 | B2 | 9/2003 | Gottesman |
| 6,621,935 | B1 | 9/2003 | Xin et al. |
| 6,633,841 | B1 | 10/2003 | Thyssen et al. |
| 6,647,063 | B1 | 11/2003 | Oikawa |
| 6,647,366 | B2 | 11/2003 | Wang et al. |
| 6,658,383 | B2 | 12/2003 | Kosihida et al. |
| 6,693,964 | B1 | 2/2004 | Zhang et al. |
| 6,732,070 | B1 | 5/2004 | Rotola-Pukkila et al. |
| 6,757,654 | B1 | 6/2004 | Westerlund et al. |
| 6,772,126 | B1 | 8/2004 | Simpson et al. |
| 6,775,649 | B1 | 8/2004 | DeMartin |
| 6,823,303 | B1 | 11/2004 | Su et al. |
| 6,934,678 | B1 | 8/2005 | Yang |
| 6,952,668 | B1 | 10/2005 | Kapilow |
| 6,968,309 | B1 * | 11/2005 | Makinen et al. ..... 704/219 |
| 7,002,913 | B2 * | 2/2006 | Huang et al. ..... 370/230.1 |
| 7,003,448 | B1 | 2/2006 | Lauber et al. |
| 7,065,338 | B2 | 6/2006 | Mano et al. |
| 7,117,156 | B1 * | 10/2006 | Kapilow ..... 704/267 |
| 7,246,037 | B2 | 7/2007 | Evans |
| 7,356,748 | B2 | 4/2008 | Taleb |
| 2001/0023395 | A1 | 9/2001 | Su et al. |
| 2002/0072901 | A1 | 6/2002 | Bruhn |
| 2002/0097807 | A1 | 7/2002 | Gerrits |
| 2002/0159472 | A1 | 10/2002 | Bialik |
| 2003/0004718 | A1 | 1/2003 | Rao |
| 2003/0009326 | A1 | 1/2003 | Wang et al. |
| 2003/0016630 | A1 | 1/2003 | Vega-Garcia et al. |
| 2003/0072464 | A1 | 4/2003 | Kates |
| 2003/0101050 | A1 | 5/2003 | Khalil |
| 2003/0115050 | A1 | 6/2003 | Chen et al. |
| 2003/0115051 | A1 | 6/2003 | Chen et al. |
| 2003/0135631 | A1 | 7/2003 | Li et al. |
| 2005/0075869 | A1 | 4/2005 | Gersho et al. |
| 2005/0165603 | A1 | 7/2005 | Bessette et al. |
| 2005/0228651 | A1 | 10/2005 | Wang et al. |
| 2005/0267753 | A1 | 12/2005 | Yang |
| 2005/0281345 | A1 | 12/2005 | Obernosterer et al. |
| 2006/0271354 | A1 | 11/2006 | Sun et al. |
| 2006/0271355 | A1 | 11/2006 | Wang et al. |
| 2007/0088558 | A1 | 4/2007 | Vos et al. |
| 2007/0255558 | A1 | 11/2007 | Yasunaga et al. |
| 2007/0255559 | A1 | 11/2007 | Gao et al. |
| 2008/0232612 | A1 | 9/2008 | Tourwe |

FOREIGN PATENT DOCUMENTS

| | | |
|---|---|---|
| EP | 0 503 684 | 9/1992 |
| FR | 2 784 218 | 4/2000 |
| GB | 2 324 689 | 10/1998 |
| JP | 1013200 | 1/1989 |
| JP | 07-297726 | 11/1995 |
| JP | 08-263098 | 10/1996 |
| JP | 10-133695 | 5/1998 |
| JP | 10-340098 | 12/1998 |
| JP | 2000-132194 | 5/2000 |
| JP | 2002-118517 | 4/2002 |
| WO | WO 98 27543 | 6/1998 |
| WO | WO 00 11655 | 3/2002 |
| WO | WO 03 102921 | 12/2003 |

OTHER PUBLICATIONS

ITU-T, "ITU-T Recommendation G.722.1, Series G: Transmission Systems and Media, Digital Systems and Networks. Digital terminal equipments—Coding of analogue signals by methods other than PCM—Coding at 24 and 32 kbit/s for hands-free operation in systems with low frame loss," 26 pp. (1999).

ITU-T, "ITU-T Recommendation G.722.1—Corrigendum 1, Series G: Transmission Systems and Media, Digital Systems and Neworks. Digital terminal equipments—Coding of analogue signals by methods other than PCM—Coding at 24 and 32 kbits/s for hands-free operation in systems with low frame loss," 9 pp. (2000).

ITU-T, "ITU-T Recommendation G.722.1 Annex A, Series G: Transmission Systems and Media, Digital Systems and Networks. Digital terminal equipments—Coding of analogue signals by methods other than PCM—Coding at 24 and 32 kbit/s for hands-free operation in systems with low frame loss, Annex A: Packet format, capability identifiers and capability parameters" 9 pp. (2000).

ITU-T, "ITU-T Recommendation G.722.1 Annex B, Series G: Transmission Systems and Media, Digital Systems and Networks. Digital terminal equipments—Coding of analogue signals by methods other than PCM—Coding at 24 and 32 kbit/s for hands-free operation in systems with low frame loss, Annex B: Floating-point implementation for G.722.1" 9 pp. (2000).

ITU-T, "ITU-T Recommendation G.722.2, Series G: Transmission Systems and Media, Digital Systems and Networks. Digital terminal equipments—Coding of analogue signal by methods other than PCM—Wideband coding of speech at around 16 kbit/s using Adaptive Multi-Rate Wideband (AMR-WB)," 71 pp. (2003).

ITU-T, "ITU-T Recommendation G.722.2 Erratum 1, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB)," 1 p. (2004).

ITU-T, "ITU-T Recommendation G.722.2 Annex A, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex A: Comfort noise aspects,"14 pp. (2002).

ITU-T, "ITU-T Recommendation G.722.2 Annex B, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex B: Source Controlled Rate Operation," 13 pp. (2002).

ITU-T, "ITU-T Recommendation G.722.2 Annex B Erratum 1, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex B: Source Controlled Rate Operation," 1 p. (2003).

ITU-T, "ITU-T Recommendation G.722.2 Annex C Erratum 1, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex C: Fixed-point C-Code," 2 pp. (2004).

ITU-T, "ITU-T Recommendation G.722.2 Annex D, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex D: Digital test sequences," 13 pp. (2003).

ITU-T, "ITU-T Recommendation G.722.2 Annex E, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex E: Frame Structure," 27 pp. (2002).

ITU-T, "ITU-T Recommendation G.722.2 Annex E Corrigendum 1, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex E: Frame Structure," 1 p. (2003).

ITU-T, "ITU-T Recommendation G.722.2 Annex F, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex F: AMR-WB using in H.245," 10 pp. (2003).

ITU-T, "ITU-T Recommendation G.723.1, General Aspects of Digital Transmission Systems, Dual Rate Speech Coder for Multimedia Communications Transmitting at 5.3 and 6.3 kbit/s," 31 pp. (1996).

ITU-T, "ITU-T Recommendation G.723.1 Annex A, Series G: Transmission Systems and Media, Digital transmission systems—Terminal Equipments—Coding of analogue signals by methods other than PCM, Dual Rate Speech Coder for Multimedia Communications Transmitting at 5.3 and 6.3 kbit/s, Annex A: Silence compression scheme," 21 pp. (1996).

ITU-T, "ITU-T Recommendation G.723.1 Annex B, Series G: Transmission Systems and Media, Digital transmission systems—Terminal Equipments—Coding of analogue signals by methods other than PCM, Dual Rate Speech Coder for Multimedia Communications Transmitting at 5.3 and 6.3 kbit/s, Annex B: Alternative specification based on floating point arithmetic," 8 pp. (1996).

ITU-T, "ITU-T Recommendation G.723.1 Annex C, Series G: Transmission Systems and Media, Digital transmission systems—Terminal Equipments—Coding of analogue signals by methods other than PCM, Dual Rate Speech Coder for Multimedia Communications Transmitting at 5.3 and 6.3 kbit/s, Annex C: Scalable channel coding scheme for wireless applications," 23 pp. (1996).

ITU-T, "ITU-T Recommendation G.728, General Aspects of Digital Transmission Systems; Terminal Equipment Coding of Speech at 16 kbit/s Using Low-Delay Code Excited Linear Prediction," 65 pp. (1992).

ITU-T, "ITU-T Recommendation G.728 Annex G, General Aspects of Digital Transmission Systems; Terminal Equipment Coding of Speech at 16 kbit/s Using Low-Delay Code Excited Linear Prediction, Annex G: 16 kbit/s Fixed Point Specification," 67 pp. (1994).

ITU-T, "ITU-T Recommendation G.728 Annex G Corrigendum 1, Series G: Transmission Systems and Media, Digital Systems and Networks, Digital Transmission Systems; Terminal Equipment Coding of Analogue Signals by methods other than PCM, Coding of speech at 16 kbit/s Using Low-Delay Code Excited Linear Prediction, Annex G: 26 kbit/s Fixed Point Specification—Corrigendum 1," 11 pp. (2000).

ITU-T, "ITU-T Recommendation G.728 Annex H, Series G: Transmission Systems and Media, Digital Systems and Networks, Digital Transmission Systems; Terminal Equipment Coding of Analogue Signals by methods other than PCM, Coding of speech at 16 kbit/s Using Low-Delay Code Excited Linear Prediction, Annex H: Variable bit rate LD-CELP operation mainly for DCME at rates less than 16 kbit/s," 19 pp. (1999).

ITU-T, "ITU-T Recommendation G.728 Annex I, Series G: Transmission Systems and Media, Digital Systems and Networks, Digital Transmission Systems; Terminal Equipment Coding of Analogue Signals by methods other than PCM, Coding of speech at 16 kbit/s Using Low-Delay Code Excited Linear Prediction, Annex I: Frame or packet loss concealment for the LD-CELP decoder," 25 pp. (1999).

ITU-T, "ITU-T Recommendation G.728 Annex J, Series G: Transmission Systems and Media, Digital Systems and Networks, Digital Transmission Systems; Terminal Equipment Coding of Analogue Signals by methods other than PCM, Coding of speech at 16 kbit/s Using Low-Delay Code Excited Linear Prediction, Annex J: Variable bit-rate operation of LD-CELP mainly for voiceband-data applications in DCME," 40 pp. (1999).

ITU-T, "ITU-T Recommendation G.729, Coding of Speech at 8 kbit/s Using Conjugate-Structure Algebraic-Code Excited Linear-Prediction (CS-ACELP)," 39 pp. (1996).

Andersen et al., "ILBC—a Linear Predictive Coder with Robustness of Packet Losses," Proc. IEEE Workshop on Speech Coding, 2002, pp. 23-25 (2002).

Feldbauer et al., "Speech Coding Using Motion Picture Compression Techniques," Proc. IEEE Workshop on Speech Coding, 2002, pp. 47-49 (2002).

Fout, "Media Support in the Microsoft Windows Real-Time Communications Client," 6 pp. [Downloaded from the World Wide Web on Feb. 26, 2004.].

Morinaga et al., "The Forward-Backward Recovery Sub-Codec (FB-RSC) Method: A Robust Form of Packet-Loss Concealment for Use in Broadband IP Networks," Proc. IEEE Workshop on Speech Coding, 2002, pp. 62-64 (2002).

Wang et al., "A 1200/2400 BPS Coding Suite Based on MELP," Proc. IEEE Workshop on Speech Coding, 2002, pp. 90-92 (2002).

Wang et al., "Wideband Speech Coder Employing T-codes and Reversible Variable Length Codes," Proc. IEEE Workshop on Speech Coding, 2002, pp. 117-119 (2002).

Salami et al., "The Adaptive Multi-Rate Wideband Codec: History and Performance," Proc. IEEE Workshop on Speech Coding, 2002, pp. 144-146 (2002).

Lakaniemi et al., "AMR and AMR-WB RTP Payload Usage in Packet Switched Conversational Multimedia Services," Proc. IEEE Workshop on Speech Coding, 2002, pp. 147-149 (2002).

Johansson et al., "Bandwidth Efficient AMR Operation for VoIP," Proc. IEEE Workshop on Speech Coding, 2002, pp. 150-152 (2002).

Makinen et al., "The Effect of Source Based Rate Adaptation Extension in AMR-WB Speech Codec," Proc. IEEE Workshop on Speech Coding, 2002, pp. 153-155 (2002).

Koishida et al., "Enhancing MPEG-4 CELP by Jointly Optimized Inter/Intra-frame LSP Predictors," Proc. IEEE Workshop on Speech Coding, 2000, pp. 90-92 (2000).

Wang et al. "Performance Comparison of Intraframe and Interframe LSF Quantization in Packet Networks," Proc. IEEE Workshop on Speech Coding, 2000, pp. 126-128 (2000).

Erdmann et al., "An Adaptive Multi Rate Wideband Speech Codec with Adaptive Gain Re-quantization," Proc. IEEE Workshop on Speech Coding, 2000, pp. 145-147 (2000).

Swaminathan et al., "A Robust Low Rate Voice Codec for Wireless Communications," Proc. 1997 IEEE Workshop on Speech Coding for Telecommunications, pp. 75-76 (1997).

Rahikka et al., "Error Coding Strategies for MELP Vocoder in Wireless and ATM Environments," IEEE Seminar on Speech Coding for Algorithms for Radio Channels, pp. 8/1-8/3 (2000).

Erhart et al., "A speech packet recovery technique using a model based tree search interpolator," Proc. 1993 IEEE Workshop on Speech Coding for Telecommunications, pp. 77-78 (1993).

Ikeda et al., "Error-Protected TwinVQ Audio Coding at Less Than 64 kbit/s/ch," Proc. 1995 IEEE Workshop on Speech Coding for Telecommunications, pp. 33-34 (1995).
Microsoft Corporation, "Using the Windows Media Audio 9 Voice Codec," 4 pp. [Downloaded from the World Wide Web on Feb. 26, 2004.].
Taumi et al., "13kbps Low-Delay Error-Robust Speech Coding for GSM EFR," 1995 IEEE Workshop on Speech Coding for Telecommunications, pp. 61-62 (1995).
Heinen et al., "Robust Speech Transmission Over Noisy Channels Employing Non-linear Block Codes," Proc. 1999 IEEE Workshop on Speech Coding, pp. 72-74 (1999).
Fingscheidt et al., "Joint Speech Codec Parameter and Channel Decoding of Parameter Individual Block Codes (PIBC)," Proc. 1999 IEEE Workshop on Speech Coding, pp. 75-77 (1999).
Rahikka et al., "Optimized Error Correction of MELP Speech Parameters Via Maximum A Posteriori (MAP) Techniques," Proc. 1999 IEEE Workshop on Speech Coding, pp. 78-80 (1999).
Kubin et al., "Multiple-Description Coding (MDC) of Speech with an Invertible Auditory Model," Proc. 1999 IEEE Workshop on Speech Coding, pp. 81-83 (1999).
Ozawa et al., "Study and Subjective Evaluation on MPEG-4 Narrowband CELP Coding Under Mobile Communication Conditions," Proc. 1999 IEEE Workshop on Speech Coding, pp. 129-131 (1999).
Nomura et al., "Voice Over IP Systems with Speech Bitrate Adaptation Based on MPEG-4 Wideband CELP," Proc. 1999 IEEE Workshop on Speech Coding, pp. 132-134 (1999).
Salami et al., "A robust transformed binary vector excited coder with embedded error-correction coding," IEEE Colloquium on Speech Coding, pp. 5/1-5/6 (1989).
Gerson et al., "Vector Sum Excited Linear Prediction (VSELP) Speech Coding at 8 KBPS," CH2847-2/90/0000-0461 IEEE, pp. 461-464 (1990).
Gersho et al., "Advances in Speech and Audio Compression," Proc. Of IEEE, pp. 900-918, vol. 82, No. 6 (1994).
Ramjee et al., "Adaptive Playout Mechanisms for Packetized Audio Application sin Wide-Area Networks," 0743-166X/94 IEEE, pp. 680-688 (1994).
Liang, et al., "Adaptive Playout Scheduling and Loss Concealment for Voice Communication Over IP Networks," IEEE Transactions on Multimedia, vol. 5, No. 4, pp. 532-543 (2003).
Sreenan et al., "Delay Reduction Techniques for Playout Buffering," IEEE Transactions on Multimedia, vol. 2, No. 2, pp. 88-100 (2000).
Tasaki et al., "Spectral Postfilter Design Based on LSP Transformation," 0-7803-4073-6/97 IEEE, pp. 57-58 (1997).
Kroon et al., "Quantization Procedures for the Excitation of Celp Coders," CH2396-0/87/0000-1649 IEEE, pp. 1649-1652 (1987).
Lefebvre et al., "Spectral Amplitude Warping (SAW) for Noise Spectrum Shaping in Audio Coding," IEEE, pp. 335-338 (1997).
Mustapha et al., "An Adaptive Post-Filtering Technique Based on the Modified Yule-Walker Filter," ICASSP-1999, 4 pp. (1999).
Chen et al., "Adaptive Postfiltering for Quality Enhancement of Coded Speech," IEEE Transactions on Speech and Audio Processing, vol. 3, No. 1, pp. 59-71 (1995).
Schroeder et al., "Code-Excited Linear Prediction (CELP): High-Quality Speech at Very Low Bit Rates," CH2118-8/85/0000-0937 IEEE, pp. 937-940 (1985).
B. Bessette, R. Salami, C. Laflamme and R. Lefebvre, "A Wideband Speech and Audio Codec at 16/24/32 kbit/s using Hybrid ACELP/TCX Techniques," in Proc. IEEE Workshop on Speech Coding, pp. 7-9, 1999.
J-H. Chen and D. Wang, "Transform Predictive Coding of Wideband Speech Signals," in Proc. International Conference on Acoustic, Speech, Signal Processing, pp. 275-278, 1996.
Combescure, P., et al., "A16, 24, 32 kbit/s Wideband Speech Codec Based on ATCELP," *In Proceedings of IEEE International Conference on Acoustics, Speech, and Signal Processing*, vol. 1, pp. 5-8 (Mar. 1999).
El Maleh, K., et al., "Speech/Music Discrimination for Multimedia Applications," *In Proceedings of IEEE International Conference on Acoustics, Speech, and Signal Processing*, vol. 4, pp. 2445-2448, (Jun. 2000).
Ellis, D., et al. "Speech/Music Discrimination Based on Posterior Probability Features," *In Proceedings of Eurospeech*, 4 pages, Budapest (1999).
Gersho, A., et al., "Vector Quantization and Signal Compression", Dordrecht, Netherlands,: Kluwer *Academic Publishers*, 1992, xxii+732pp.
Hardwick, J.C.; Lim, J.S., "A 4.8 KBPS Multi-Brand Excitation Speech Coder", *ICASSP 1988 International Conference on Acoustics, Speech, and Signal*, New York, NY, USA, Apr. 11-14, 1988,: *IEEE*, vol. 1, pp. 374-377.
Houtgast, T., et al., "The Modulation Transfer Function in Room Acoustics As A Predictor or Speech Intelligibility," *Acustica*, vol. 23, pp. 66-73 (1973).
ITU-T, G.722.1 (Sep. 1999), Series G: Transmission Systems and Media, Digital Systems and Networks, Coding at 24 and 32 kbit/s for hands-free operation in systems with low frame loss.
Kabal et al., "Adaptive Postfiltering for Enhancement of Noisy Speech in the Frequency Domain," CH 3006-4/91/0000-0312 IEEE, pp. 312-315.
Kemp, D.P.; Collura J.S., ; Tremain, T.E., Multi-Frame Coding of LPC Acoustics, Speech, and Signal Processing, Toronto, Ont., Canada, May 14-17, 1991; New York, N.Y. USA, *IEEE*, 1991, vol. 1, pp. 609-612.
Leblanc, W.P., et al., "Efficient Search and Design Procedures for Robust Multi-Stage VQ of LPC Parameters for 4KB/S Speech Coding". In *IEEE Trans. Speech & Audio Processing*, vol. 1, pp. 272-285, (Oct. 1993).
Lefebvre, et al., "High quality coding of wideband audio signals using transform coded excitation (TCS)," Apr. 1994, 1994 IEEE International Conference on Acoustics, Speech, and Signal Processing, vol. 1, pp. I/193-I/196.
McCree, et al., "A 2.4 KBIT/S MELP Coder Candidate for the New U.S. Federal Standard", *1996 IEEE International Conference on Acoustics, Speech, and Signal Processing Conference Proceedings*, Atlanta, GA (Cat. No. 96CH35903), vol. 1, pp. 200-203, May 7-10, 1996.
McCree, A.V., et al., "A Mixed Excitation LPC Vocoder Model for Low Bit Rate Speech Coding", *IEEE Transaction on Speech and Audio Processing*, vol. 3(4):242-250 (Jul. 1995).
Mouy, B. et al., "Nato Stanag 4479: A Standard for An 800 BPS Vocoder and Channel Coding In HF-ECCM System", 1995 International Conference on Acoustics, Speech, and Signal Processing Conference Proceedings, Detroit MI, USA, May 9-12 1999; New York, NY, USA: *IEEE*, 1995, vol. 1, pp. 480-483.
Mouy, B.M.; De La Noure, P.E., "Voice Transmission at a Very Low Bit Rate on A Noisy Channel: 800 BPS Vocoder with Error Protection to 1200 BPS", *ICASSP-92: 1992 IEEE International Conference on Acoustics, Speech, and Signal*, San Francisco, CA, USA, Mar. 23-26, 1992, New York, NY, USA: *IEEE*, 1992 vol. 2, pp. 149-152.
Nishiguchi, L.; Iijima, K.; Matsumoto, J., "Harmonic Vector Excitation Coding of Speech at 2.0 KPS", *1997 IEEE Workshop on Speech coding for telecommunication proceedings*, Pocono Manor, PA, USA, Sep. 7-10, 1997, New York, NY, USA,: *IEEE*, 1997, pp. 39-40.
Nomura, T.; Iwadare, M.; Serizawa, M.; Ozawa, K., "a Bitrate and Bandwidth Scalable Celp Coder", *ICASSP 1998 International Conference on Acoustics, Speech, and Signal*, Seattle, WA, USA, May 12-15, 1998, *IEEE*, 1998, vol. 1, pp. 341-344.
S.A. Ramprashad, "A Multimode Transform Predictive Coder (MTPC) for Speech and Audio," in Proc. IEEE Workshop on Speech Coding, pp. 10-12, 1999.
Salami, et al., "A wideband codec at 16/24 kbit/s with 10 ms frames," Sep. 1997, 1997 Workshop on Speech Coding for Telecommunications, pp. 103-104.
Saunders, J., "Real Time Discrimination of Broadcoast Speech/Music," *Proceedings of IEEE International Conference on Acoustics, Speech, and Signal Processing*, vol. 2, pp. 993-996 (May 1996).
Scheirer, E., et al., "Construction and Evaluation of a Robust Multifeature Speech/Music Discriminator," *In Proceedings of IEEE International Conference on Acoustics, Speech, and Signal Processing*, vol. 2, pp. 1331-1334, (Apr. 1997).

J. Schnitzler, J. Eggers, C. Erdmann and P. Vary, "Wideband Speech Coding Using Forward/Backward Adaptive Prediction with Mixed Time/Frequency Domain Excitation," in Proc. IEEE Workshop on Speech Coding, pp. 3-5, 1999.

Supplee, Lyn M. et al., "MELP: The New Federal Standard At 2400 BPS", *IEEE 1997*, pp. 1591-1594 in lieu of the following which we are unable to obtain *Specification for the Analog to Digital Conversation of Voice by 2,400 Bit/Second Mixed Excitation Linear Prediction FIPS, Draft document of prosposed Federal Standard*, dated May 28, 1998.

L. Tancerel, R. Vesa, V.T. Ruoppila and R. Lefebvre, "Combined Speech and Audio Coding by Discrimination," in Proc. IEEE Workshop on Speech Coding, pp. 154-156, 2000.

Tasaki et al., "Post Noise Smoother to Improve Low Bit Rate Speech-Coding Performance," 0-7803-5651-9/99 IEEE, pp. 159-161 (1999).

Tzanetakis, G., et al., "Multifeature Audio Segmentation for Browsing and Annotation," *Proc. IEEE Workshop on Applications of Signal Processing to Audio and Acoustics*, New Paltz, NY, pp. 103-106 (Oct. 1999).

A. Ubale and A. Gersho, "Multi-Band CELP Wideband Speech Coder," Proc. IEEE Int. Conf. on Acoustics, Speech and Signal Processing, Munich, pp. 1367-1370.

Wang, Tian et al., "A 1200 BPS Speech Coder Based on MELP", *in Proceedings of the IEEE International Conference on Acoustics, Speech and Signal Processing*, Jun. 2000, pp. 1375-1378.

Mcaulay, "Sine-Wave Amplitude Coding at Low Data Rates, Advances in Speech Coding," Kluwer Academic Pub., pp. 203-214, 1991.

International Search Report and Written Opinion for PCT/US2006/12641.

European Search Report for PCT/US2006/12686 dated Aug. 13, 2008, 8 pages.

International Search Report and Written Opinion for PCT/US2006/13010 dated Nov. 8, 2007, 10 pages.

* cited by examiner

ROBUST DECODER

RELATED APPLICATION INFORMATION

This application is a continuation of U.S. patent application Ser. No. 11/142,602, entitled "Robust Decoder" filed May 31, 2005, the disclosure of which is incorporated herein by reference in its entirety, including all text and drawings thereof.

TECHNICAL FIELD

Described tools and techniques relate to audio codecs, and particularly to techniques for dealing with delayed or lost encoded audio information.

BACKGROUND

With the emergence of digital wireless telephone networks, streaming audio over the Internet, and Internet telephony, digital processing and delivery of speech has become commonplace. Engineers use a variety of techniques to process speech efficiently while still maintaining quality. To understand these techniques, it helps to understand how audio information is represented and processed in a computer.

I. Representation of Audio Information in a Computer

A computer processes audio information as a series of numbers representing the audio. A single number can represent an audio sample, which is an amplitude value at a particular time. Several factors affect the quality of the audio, including sample depth and sampling rate.

Sample depth (or precision) indicates the range of numbers used to represent a sample. More possible values for each sample typically yields higher quality output because more subtle variations in amplitude can be represented. An eight-bit sample has 256 possible values, while a sixteen-bit sample has 65,536 possible values.

The sampling rate (usually measured as the number of samples per second) also affects quality. The higher the sampling rate, the higher the quality because more frequencies of sound can be represented. Some common sampling rates are 8,000, 11,025, 22,050, 32,000, 44,100, 48,000, and 96,000 samples/second (Hz). Table 1 shows several formats of audio with different quality levels, along with corresponding raw bit rate costs.

TABLE 1

Bit rates for different quality audio

| Sample Depth (bits/sample) | Sampling Rate (samples/second) | Channel Mode | Raw Bit Rate (bits/second) |
|---|---|---|---|
| 8 | 8,000 | mono | 64,000 |
| 8 | 11,025 | mono | 88,200 |
| 16 | 44,100 | stereo | 1,411,200 |

As Table 1 shows, the cost of high quality audio is high bit rate. High quality audio information consumes large amounts of computer storage and transmission capacity. Many computers and computer networks lack the resources to process raw digital audio. Compression (also called encoding or coding) decreases the cost of storing and transmitting audio information by converting the information into a lower bit rate form. Compression can be lossless (in which quality does not suffer) or lossy (in which quality suffers but bit rate reduction from subsequent lossless compression is more dramatic). Decompression (also called decoding) extracts a reconstructed version of the original information from the compressed form. A codec is an encoder/decoder system.

II. Speech Encoders and Decoders

One goal of audio compression is to digitally represent audio signals to provide maximum signal quality for a given amount of bits. Stated differently, this goal is to represent the audio signals with the least bits for a given level of quality. Other goals such as resiliency to transmission errors and limiting the overall delay due to encoding/transmission/decoding apply in some scenarios.

Different kinds of audio signals have different characteristics. Music is characterized by large ranges of frequencies and amplitudes, and often includes two or more channels. On the other hand, speech is characterized by smaller ranges of frequencies and amplitudes, and is commonly represented in a single channel. Certain codecs and processing techniques are adapted for music and general audio; other codecs and processing techniques are adapted for speech.

One type of conventional speech codec uses linear prediction to achieve compression. The speech encoding includes several stages. The encoder finds and quantizes coefficients for a linear prediction filter, which is used to predict sample values as linear combinations of preceding sample values. A residual signal (represented as an "excitation" signal) indicates parts of the original signal not accurately predicted by the filtering. At some stages, the speech codec uses different compression techniques for voiced segments (characterized by vocal chord vibration), unvoiced segments, and silent segments, since different kinds of speech have different characteristics. Voiced segments typically exhibit highly repeating voicing patterns, even in the residual domain. For voiced segments, the encoder achieves further compression by comparing the current residual signal to previous residual cycles and encoding the current residual signal in terms of delay or lag information relative to the previous cycles. The encoder handles other discrepancies between the original signal and the predicted, encoded representation (from the linear prediction and delay information) using specially designed codebooks.

Although some speech codecs described above have good overall performance for many applications, they have several drawbacks. In particular, several drawbacks surface when the speech codecs are used in conjunction with dynamic network resources. In such scenarios, encoded speech may be lost because of a temporary bandwidth shortage or other problem.

A. Ineffective Concealment Techniques

When one or more packets of encoded speech are missing, such as by where they are lost, delayed, corrupted or otherwise made unusable in transit or elsewhere, decoders often attempt to conceal the missing packets in some manner. For example, some decoders simply repeat packets that have already been received. If there are significant losses of packets, however, this technique can quickly result in degraded quality of the decoded speech output.

Some codecs use more sophisticated concealment techniques, such as the waveform similarity overlap-add method ("WSOLA"). This technique extends the decoded audio signal to conceal missing packets by generating new pitch cycles through weighted averages of existing pitch cycles. This method can be more effective in concealing missing packets than merely repeating earlier packets. However, it may not be ideal for all situations. Moreover, it can produce undesirable sound effects (such as a mechanical or ringing sound), if it is used to extend a signal for too long.

Additionally, many frames depend on memory of decoded characteristics of previous frames (such as excitation signal history) for decoding. When such memory does not exist (as where the packets that would have been used to produce the memory are lost, delayed, etc.), the signal quality may be degraded even for the received frames that follow missing frames.

B. Inefficient or Ineffective Desired Packet Delay Calculations

As packets of encoded audio information are being transported to a decoder application, each packet may experience a different delay due to, for example, network variations. This can also result in packets arriving in a different order than they were sent. An application or decoder may calculate delay statistics to determine a desired decoder buffer delay that is expected to be long enough to allow a sufficient number of packets to arrive at the decoder in time to be decoded and used. Of course, a countervailing concern may be overall delay in the system, especially for real-time, interactive applications such as telephony.

One approach to calculating the optimal delay is to look at the maximum delay of previous packets and use that delay value as a guide. The delay of a packet is typically determined by calculating the difference between a sent time stamp applied on the encoder side when the packet is sent and a received time stamp applied on the decoder side when the packet is received. However, sometimes outliers may exist, causing the system to adapt to unrepresentative packets. In addition, it is sometimes better to let a few packets arrive too late (and be missed) than to impose a delay long enough to receive those outlier, late packets.

One alternative is calculating the desired delay based on formulas such as running averages, and running variance calculations. However, many parameters need to be optimized in such calculations, and it is difficult to find the right tradeoff between calculation and response speed on the one hand, and basing the calculations on a representative population of history values on the other hand.

Another approach is to directly analyze the packet delay distribution. For example, a histogram of packet delays may be maintained. The width of a bin in the delay time histogram represents the desired accuracy with which the optimal delay will be calculated. Decreasing the bin size improves the accuracy. The shape of the histogram approximately mirrors the underlying packet delay distribution.

When a new packet arrives, the packet delay is mapped to the corresponding bin and the count of the packets that fall into that bin is incremented. To reflect the age of some old packets, counts in all other bins are scaled down in a process called "aging." To find the new desired delay, the decoder sets a desired loss rate. Typical values range between one percent and five percent. The histogram is analyzed to determine the value of the desired delay that is needed to achieve the desired loss. One problem with this approach is that some parameters need to be tuned, such as bin width, and aging factors. In addition, all old packets are treated similarly in the aging process, and the aging approach itself plays an overly significant role in the overall performance of the technique. In addition, a clock-drift situation may occur. Clock drift occurs when the clock rates of different devices are not the same. If clock drift occurs between encoder-side devices that apply sent time stamps and decoder-side devices that apply received time stamps, the overall delay has either a positive or a negative trend. This can cause the histogram to drift along the delay timeline even when the histogram should be static.

SUMMARY

In summary, the detailed description is directed to various techniques and tools for audio codecs and specifically to tools and techniques related to techniques for dealing with audio information that is missing for any reason. Described embodiments implement one or more of the described techniques and tools including, but not limited to, the following:

In one aspect, if one or more missing frames is encountered while processing a bit stream for an audio signal, then a concealment technique is selected from among multiple available signal-dependent concealment techniques based at least in part on one or more factors. The selected concealment technique is performed and a result is output.

In another aspect, when encountering one or more frames missing from a bit stream for an audio signal, a concealment signal based at least in part on pitch cycles in one or more previous frames is generated, including introducing pitch jitter.

In another aspect, one or more frames missing from a bit stream for an audio signal is encountered and a concealment signal is produced. A subsequent frame is encountered that relies at least in part on information from the one or more missing frames for decoding. Substitute information from the concealment signal is produced and relied on in place of the information from the one or more missing frames to decode the subsequent frame.

In another aspect, a bit stream for an audio signal is processed. When one or more frames missing from the bit stream is encountered, then the processing includes generating a concealment signal including an extension signal contribution based at least in part on one or more values associated with an available frame, and, after a threshold duration of the concealment signal, adding a noise contribution to the concealment signal. When encountering the one or more missing frames from the bit stream, the processing may further include gradually decreasing energy of the extension signal contribution along at least part of the audio signal, and gradually increasing energy of the noise contribution along the at least part of the audio signal. Moreover, gradually decreasing the energy of the extension signal contribution may include gradually decreasing the energy until the extension signal is imperceptible. Also, the energy of the extension signal contribution may be gradually decreased and the energy of the noise contribution may be gradually increased until the concealment signal consists essentially of a predetermined level of background noise.

In another aspect, a bit stream for an audio signal is processed. When encountering one or more missing frames from the bit stream, the processing includes identifying plural available segments from an available frame, and for each of the plural available segments, using one or more characteristics of the available segment to generate a derived segment. A merged signal is formed using the plural available segments and the plural derived segments. The available frame may be an unvoiced frame, and the one or more characteristics may include energy of the available segment. The plural available segments may include first and second available segments, the plural derived segments may include first and second derived segments, and forming the merged signal may include merging the first available segment with the first derived segment, merging the first derived segment with the second derived segment, and merging the second derived segment with the second available segment. The plural available segments may include more than two available segments, and the plural derived segments may include more than two derived segments. Also, the processing may further include using the merged segment in place of the available frame and the one or more missing frames.

In another aspect, a data structure is maintained. The data structure includes a set of plural nodes that correspond to packets in a set of received packets. Each node of the set of plural nodes includes a delay value for receipt of a corresponding packet of the set of received packets, a higher value pointer that points to a node of the set of plural nodes with a next higher delay value, and a lower value pointer that points to a node of the set of plural nodes with a next lower delay value. A desired decoder packet delay value is determined based at least in part on the data structure. When a new packet is received, maintaining the data structure may include replacing a delay value of an oldest packet out of the set of received packets with a delay value of the new packet, updating the high value pointer of one or more nodes of the set of plural nodes, and updating the low value pointer of one or more nodes of the set of plural nodes. Moreover, determining the desired decoder packet delay value may include locating a node of the set of plural nodes comprising a maximum delay value, searching nodes of the set of plural nodes with successively lower delay values until a desired number of nodes has been searched, and using the delay value of the last node to be searched as a desired packet delay for the decoder. Also, the desired number of nodes may correspond to a predetermined desired packet loss rate.

The various techniques and tools can be used in combination or independently.

Additional features and advantages will be made apparent from the following detailed description of different embodiments that proceeds with reference to the accompanying drawings.

DETAILED DESCRIPTION

Described embodiments are directed to techniques and tools for processing audio information in encoding and/or decoding. With these techniques the quality of speech derived from a speech codec, such as a real-time speech codec, is improved. Such improvements may result from the use of various techniques and tools separately or in combination.

Such techniques and tools may include choosing a concealment technique based on characteristics of the audio signal and/or using pitch jittering in conjunction with pitch extension concealment techniques. The techniques may also include encoding some or all of a signal resulting from concealment techniques and using the encoded information to regenerate the memory used for decoding future packets. Additionally, the techniques may include calculating a desired packet delay value using a data structure adapted for tracking and ordering packet delays.

Although operations for various techniques are described in a particular, sequential order for the sake of presentation, it should be understood that this manner of description encompasses minor rearrangements in the order of operations, unless a particular ordering is required. For example, operations described sequentially may in some cases be rearranged or performed concurrently. Moreover, for the sake of simplicity, flowcharts may not show the various ways in which particular techniques can be used in conjunction with other techniques.

While particular computing environment features and audio codec features are described below, one or more of the tools and techniques may be used with various different types of computing environments and/or various different types of codecs. For example, one or more of the robust decoder techniques may be used with codecs that do not use the CELP coding model, such as adaptive differential pulse code modulation codecs, transorm codecs and/or other types of codecs. As another example, one or more of the robust decoder techniques may be used with single band codecs or sub-band codecs. As another example, one or more of the robust decoder techniques may be applied to a single band of a multi-band codec and/or to a synthesized or unencoded signal including contributions of multiple bands of a multi-band codec.

I. Computing Environment

Figure 1:
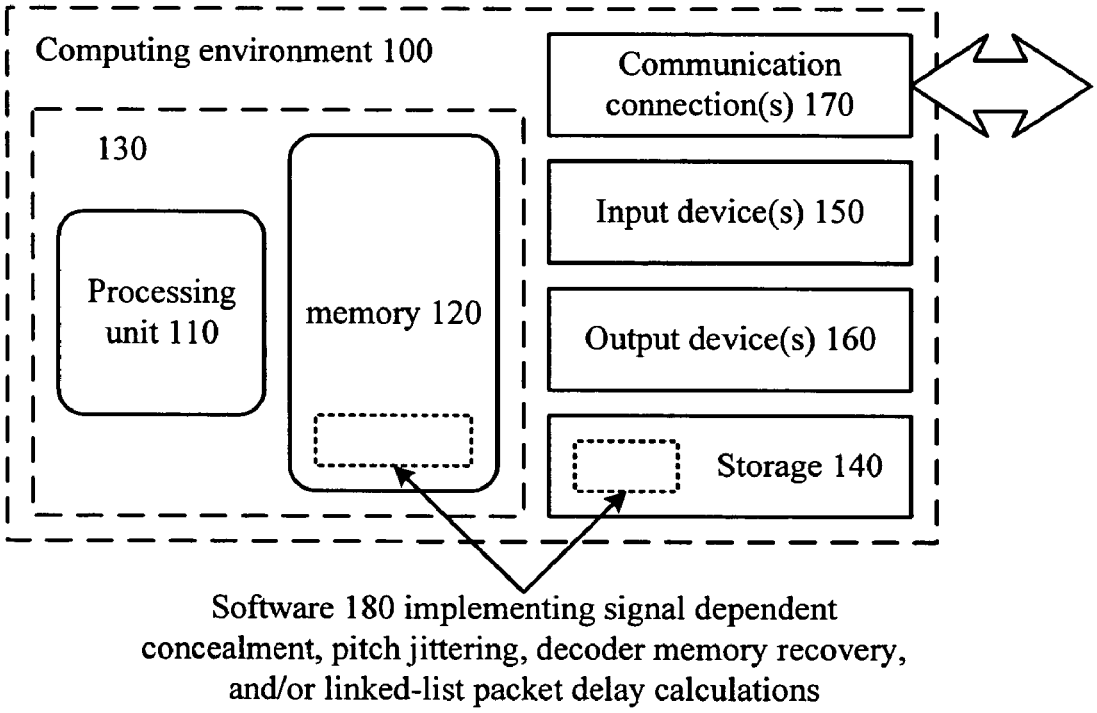
FIG. 1 is a block diagram of a suitable computing environment in which one or more of the described embodiments may be implemented.

FIG. 1 illustrates a generalized example of a suitable computing environment (100) in which one or more of the described embodiments may be implemented. The computing environment (100) is not intended to suggest any limitation as to scope of use or functionality of the invention, as the present invention may be implemented in diverse general-purpose or special-purpose computing environments.

With reference to FIG. 1, the computing environment (100) includes at least one processing unit (110) and memory (120). In FIG. 1, this most basic configuration (130) is included within a dashed line. The processing unit (110) executes computer-executable instructions and may be a real or a virtual processor. In a multi-processing system, multiple processing units execute computer-executable instructions to increase processing power. The memory (120) may be volatile memory (e.g., registers, cache, RAM), non-volatile memory (e.g., ROM, EEPROM, flash memory, etc.), or some combination of the two. The memory (120) stores software (180) implementing techniques such as signal-dependent concealment, pitch jittering, decoder memory recovery, and/or linked-list packet delay calculations.

A computing environment (100) may have additional features. In FIG. 1, the computing environment (100) includes storage (140), one or more input devices (150), one or more output devices (160), and one or more communication connections (170). An interconnection mechanism (not shown) such as a bus, controller, or network interconnects the components of the computing environment (100). Typically, operating system software (not shown) provides an operating environment for other software executing in the computing environment (100), and coordinates activities of the components of the computing environment (100).

The storage (140) may be removable or non-removable, and may include magnetic disks, magnetic tapes or cassettes, CD-ROMs, CD-RWs, DVDs, or any other medium which can be used to store information and which can be accessed within the computing environment (100). The storage (140) stores instructions for the software (180).

The input device(s) (150) may be a touch input device such as a keyboard, mouse, pen, or trackball, a voice input device, a scanning device, network adapter, or another device that provides input to the computing environment (100). For audio, the input device(s) (150) may be a sound card, microphone or other device that accepts audio input in analog or digital form, or a CD/DVD reader that provides audio samples to the computing environment (100). The output device(s) (160) may be a display, printer, speaker, CD/DVD-writer, network adapter, or another device that provides output from the computing environment (100).

The communication connection(s) (170) enable communication over a communication medium to another computing entity. The communication medium conveys information such as computer-executable instructions, compressed speech information, or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

The invention can be described in the general context of computer-readable media. Computer-readable media are any available media that can be accessed within a computing environment. By way of example, and not limitation, with the computing environment (100), computer-readable media include memory (120), storage (140), communication media, and combinations of any of the above.

The invention can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing environment.

For the sake of presentation, the detailed description uses terms like "determine," "generate," "adjust," and "apply" to describe computer operations in a computing environment. These terms are high-level abstractions for operations performed by a computer, and should not be confused with acts performed by a human being. The actual computer operations corresponding to these terms vary depending on implementation.

II. Generalized Network Environment and Real-time Speech Codec

Figure 2:
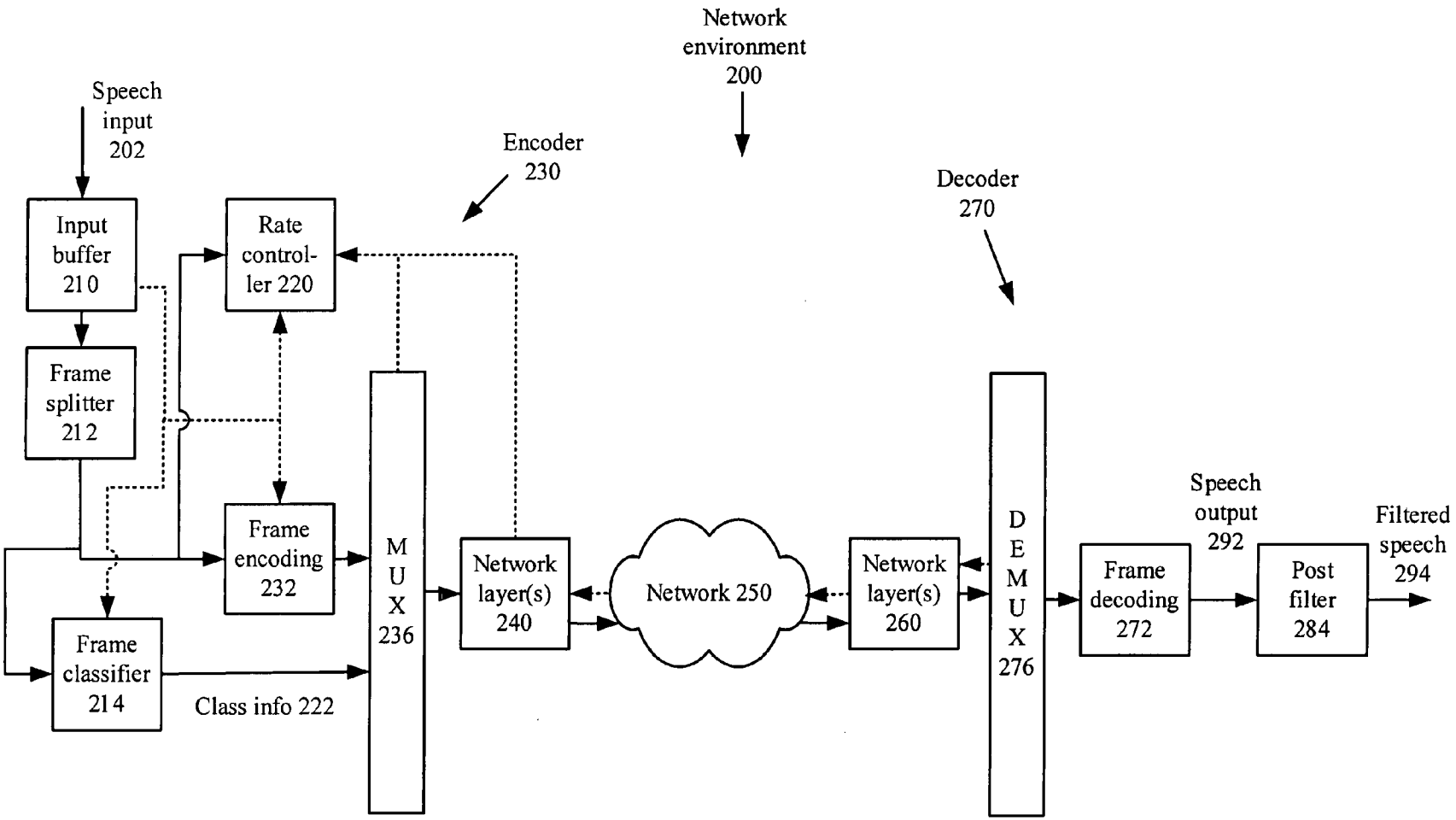
FIG. 2 is a block diagram of a network environment in conjunction with which one or more of the described embodiments may be implemented.

FIG. 2 is a block diagram of a generalized network environment (200) in conjunction with which one or more of the described embodiments may be implemented. A network (250) separates various encoder-side components from various decoder-side components.

The primary functions of the encoder-side and decoder-side components are speech encoding and decoding, respectively. On the encoder side, an input buffer (210) accepts and stores speech input (202). The speech encoder (230) takes speech input (202) from the input buffer (210) and encodes it.

Specifically, a frame splitter (212) splits the samples of the speech input (202) into frames. In one implementation, the frames are uniformly 20 ms long—160 samples for eight kHz input and 320 samples for sixteen kHz input. In other implementations, the frames have different durations, are non-uniform or overlapping, and/or the sampling rate of the input (202) is different. The frames may be organized in a super-frame/frame, frame/sub-frame, or other configuration for different stages of the encoding and decoding.

A frame classifier (214) classifies the frames according to one or more criteria, such as energy of the signal, zero crossing rate, long-term prediction gain, gain differential, and/or other criteria for sub-frames or the whole frames. Based upon the criteria, the frame classifier (214) classifies the different frames into classes such as silent, unvoiced, voiced, and transition (e.g., unvoiced to voiced). Additionally, the frames may be classified according to the type of redundant coding, if any, that is used for the frame. The frame class affects the parameters that will be computed to encode the frame. In addition, the frame class may affect the resolution and loss resiliency with which parameters are encoded, so as to provide more resolution and loss resiliency to more important frame classes and parameters. For example, silent frames are typically coded at very low rate, are very simple to recover by concealment if lost, and may not need protection against loss. Unvoiced frames typically are coded at slightly higher rate, are reasonably simple to recover by concealment if lost, and are not significantly protected against loss. Voiced and transition frames are usually encoded with more bits, depending on the complexity of the frame as well as the presence of transitions. Voiced and transition frames are also difficult to recover if lost, and so are more significantly protected against loss. Alternatively, the frame classifier (214) uses other and/or additional frame classes. In FIG. 2, each frame is encoded, as by a frame encoding component (232). Such frame encoding is described in more detail below with reference to FIG. 3. The resulting encoded speech is provided to software for one or more networking layers (240) through a multiplexer ("MUX") (236). The networking layer(s) (240) process the encoded speech for transmission over the network (250). For example, the network layer software packages frames of encoded speech information into packets that follow the RTP protocol, which are relayed over the Internet using UDP, IP, and various physical layer protocols. Alternatively, other and/or additional layers of software or networking protocols are used.

The network (250) is a wide area, packet-switched network such as the Internet. Alternatively, the network (250) is a local area network or other kind of network.

On the decoder side, software for one or more networking layers (260) receives and processes the transmitted data. The network, transport, and higher layer protocols and software in the decoder-side networking layer(s) (260) usually correspond to those in the encoder-side networking layer(s) (240).

The networking layer(s) provide the encoded speech information to the speech decoder (270) through a demultiplexer ("DEMUX") (276).

The decoder (270) decodes each frame, as is depicted in decoding module (272). The decoded speech output (292) may also be passed through one or more post-filters (284) to improve the quality of the resulting filtered speech output (294).

One generalized real-time speech frame decoder is described below with reference to FIG. 5, but other speech decoders may instead be used. Additionally, some or all of the described tools and techniques may be used with other types of audio encoders and decoders, such as music encoders and decoders, or general-purpose audio encoders and decoders.

Aside from these primary encoding and decoding functions, the components may also share information (shown in dashed lines in FIG. 2) to control the rate, quality, and/or loss resiliency of the encoded speech. The rate controller (220) considers a variety of factors such as the complexity of the current input in the input buffer (210), the buffer fullness of output buffers in the encoder (230) or elsewhere, desired output rate, the current network bandwidth, network congestion/noise conditions and/or decoder loss rate. The decoder (270) feeds back decoder loss rate information to the rate controller (220). The networking layer(s) (240, 260) collect or estimate information about current network bandwidth and congestion/noise conditions, which is fed back to the rate controller (220). Alternatively, the rate controller (220) considers other and/or additional factors.

The rate controller (220) directs the speech encoder (230) to change the rate, quality, and/or loss resiliency with which speech is encoded. The encoder (230) may change rate and quality by adjusting quantization factors for parameters or changing the resolution of entropy codes representing the parameters. Additionally, the encoder may change loss resiliency by adjusting the rate or type of redundant coding. Thus, the encoder (230) may change the allocation of bits between primary encoding functions and loss resiliency functions depending on network conditions. Alternatively, the rate is controlled in some other manner, such as where the encoder operates at a fixed rate.

Figure 3:
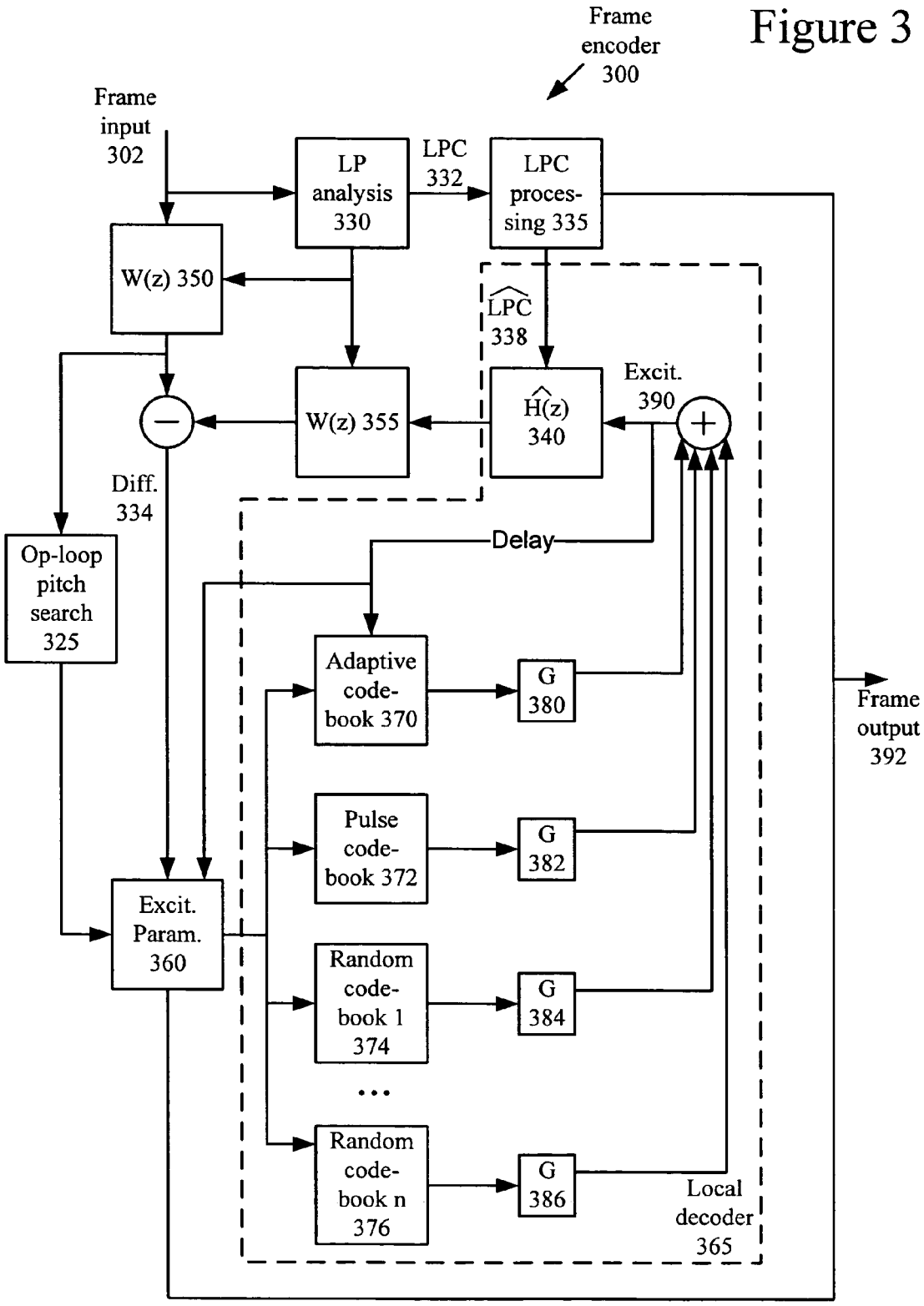
FIG. 3 is a block diagram of a real-time speech frame encoder in conjunction with which one or more of the described embodiments may be implemented.

FIG. 3 is a block diagram of a generalized speech frame encoder (300) in conjunction with which one or more of the described embodiments may be implemented. The frame encoder (300) generally corresponds to the frame encoding component (232) in FIG. 2. The frame encoder (300) accepts the frame input (302) from the frame splitter and produces encoded frame output (392).

The LP analysis component (330) computes linear prediction coefficients (332). In one implementation, the LP filter uses ten coefficients for eight kHz input and sixteen coefficients for sixteen kHz input, and the LP analysis component (330) computes one set of linear prediction coefficients per frame. Alternatively, the LP analysis component (330) computes two sets of coefficients per frame, one for each of two windows centered at different locations, or computes a different number of coefficients per frame.

The LPC processing component (335) receives and processes the linear prediction coefficients (332). Typically, the LPC processing component (335) converts LPC values to a different representation for more efficient quantization and encoding. For example, the LPC processing component (335) converts LPC values to a line spectral pair (LSP) representation, and the LSP values are quantized (such as by vector quantization) and encoded. The LSP values may be intra coded or predicted from other LSP values. Various representations, quantization techniques, and encoding techniques are possible for LPC values. The LPC values are provided in some form as part of the encoded frame output (392) for packetization and transmission (along with any quantization parameters and other information needed for reconstruction). For subsequent use in the encoder (300), the LPC processing component (335) reconstructs the LPC values. The LPC processing component (335) may perform interpolation for LPC values (such as equivalently in LSP representation or another representation) to smooth the transitions between different sets of LPC coefficients, or between the LPC coefficients used for different sub-frames of frames.

The synthesis (or "short-term prediction") filter (340) accepts reconstructed LPC values (338) and incorporates them into the filter. The synthesis filter (340) receives an excitation signal and produces an approximation of the original signal. For a given frame, the synthesis filter (340) may buffer a number of reconstructed samples (e.g., ten for a ten-tap filter) from the previous frame for the start of the prediction.

The perceptual weighting components (350, 355) apply perceptual weighting to the original signal and the modeled output of the synthesis filter (340) so as to selectively de-emphasize the formant structure of speech signals to make the auditory systems less sensitive to quantization errors. The perceptual weighting components (350, 355) exploit psychoacoustic phenomena such as masking. In one implementation, the perceptual weighting components (350, 355) apply weights based on the original LPC values (332) received from the LP analysis component (330). Alternatively, the perceptual weighting components (350, 355) apply other and/or additional weights.

Following the perceptual weighting components (350, 355), the encoder (300) computes the difference between the perceptually weighted original signal and perceptually weighted output of the synthesis filter (340) to produce a difference signal (334). Alternatively, the encoder (300) uses a different technique to compute the speech parameters.

The excitation parameterization component (360) seeks to find the best combination of adaptive codebook indices, fixed codebook indices and gain codebook indices in terms of minimizing the difference between the perceptually weighted original signal and synthesized signal (in terms of weighted mean square error or other criteria). Many parameters are computed per sub-frame, but more generally the parameters may be per super-frame, frame, or sub-frame. Table 2 shows the available types of parameters for different frame classes in one implementation.

TABLE 2

Parameters for different frame classes

| Frame class | Parameter(s) |
|---|---|
| Silent | Class information; LSP; gain (per frame, for generated noise) |
| Unvoiced | Class information; LSP; pulse, random, and gain codebook parameters (per sub-frame) |
| Voiced Transition | Class information; LSP; adaptive, pulse, random, and gain codebook parameters (per sub-frame) |

In FIG. 3, the excitation parameterization component (360) divides the frame into sub-frames and calculates codebook indices and gains for each sub-frame as appropriate. For example, the number and type of codebook stages to be used, and the resolutions of codebook indices, may initially be determined by an encoding mode, where the mode is dictated by the rate control component discussed above. A particular mode may also dictate encoding and decoding parameters other than the number and type of codebook stages, for example, the resolution of the codebook indices. The parameters of each codebook stage are determined by optimizing the parameters to minimize error between a target signal and the contribution of that codebook stage to the synthesized signal. (As used herein, the term "optimize" means finding a suitable solution under applicable constraints such as distortion reduction, parameter search time, parameter search complexity, bit rate of parameters, etc., as opposed to performing a full search on the parameter space. Similarly, the term "minimize" should be understood in terms of finding a suitable solution under applicable constraints.) For example, the optimization can be done using a modified mean-square error technique. The target signal for each stage is the difference between the residual signal and the sum of the contributions of the previous codebook stages, if any, to the synthesized signal. Alternatively, other optimization techniques may be used.

Figure 4:
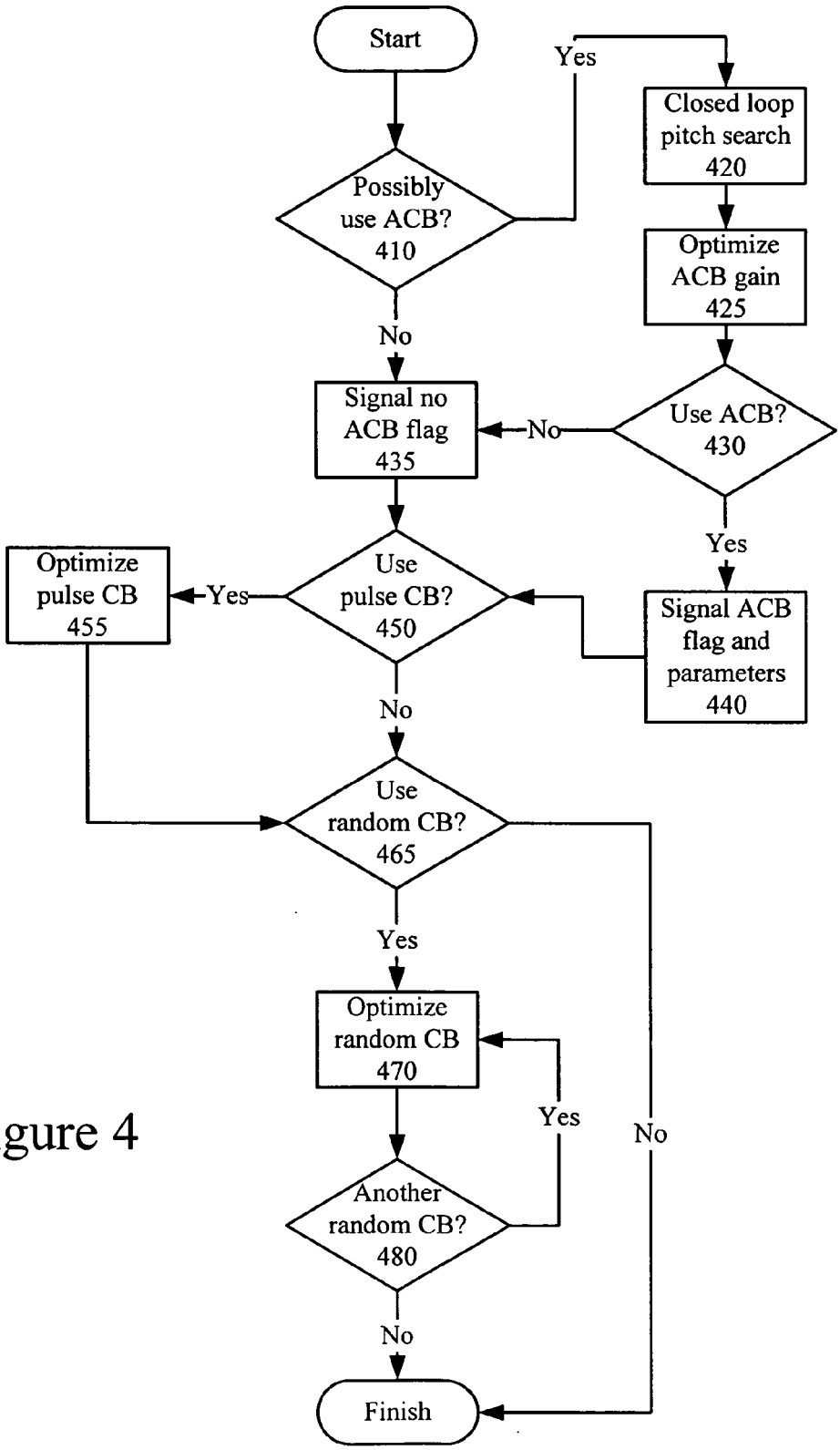
FIG. 4 is a flow diagram depicting the determination of codebook parameters in one implementation.

FIG. 4 shows a technique for determining codebook parameters according to one implementation. The excitation parameterization component (360) performs the technique, potentially in conjunction with other components such as a rate controller. Alternatively, another component in an encoder performs the technique.

Referring to FIG. 4, for each sub-frame in a voiced or transition frame, the excitation parameterization component (360) determines (410) whether an adaptive codebook may be used for the current sub-frame. (For example, the rate control may dictate that no adaptive codebook is to be used for a particular frame.) If the adaptive codebook is not to be used, then an adaptive codebook switch will indicate that no adaptive codebooks are to be used (435). For example, this could be done by setting a one-bit flag at the frame level indicating no adaptive codebooks are used in the frame, by specifying a particular coding mode at the frame level, or by setting a one-bit flag for each sub-frame indicating that no adaptive codebook is used in the sub-frame.

Referring still to FIG. 4, if an adaptive codebook may be used, then the component (360) determines adaptive codebook parameters. Those parameters include an index, or pitch value, that indicates a desired segment of the excitation signal history, as well as a gain to apply to the desired segment. In FIGS. 3 and 4, the component (360) performs a closed loop pitch search (420). This search begins with the pitch determined by the optional open loop pitch search component (325) in FIG. 3. An open loop pitch search component (325) analyzes the weighted signal produced by weighting component (350) to estimate its pitch. Beginning with this estimated pitch, the closed loop pitch search (420) optimizes the pitch value to decrease the error between the target signal and the weighted synthesized signal generated from an indicated segment of the excitation signal history. The adaptive codebook gain value is also optimized (425). The adaptive codebook gain value indicates a multiplier to apply to the pitch-predicted values (the values from the indicated segment of the excitation signal history), to adjust the scale of the values. The gain multiplied by the pitch-predicted values is the adaptive codebook contribution to the excitation signal for the current frame or sub-frame. The gain optimization (425) and the closed loop pitch search (420) produce a gain value and an index value, respectively, that minimize the error between the target signal and the weighted synthesized signal from the adaptive codebook contribution.

If the component (360) determines (430) that the adaptive codebook is to be used, then the adaptive codebook parameters are signaled (440) in the bit stream. If not, then it is indicated that no adaptive codebook is used for the sub-frame (435), such as by setting a one-bit sub-frame level flag, as discussed above. This determination (430) may include determining whether the adaptive codebook contribution for the particular sub-frame is significant enough to be worth the number of bits required to signal the adaptive codebook parameters. Alternatively, some other basis may be used for the determination. Moreover, although FIG. 4 shows signaling after the determination, alternatively, signals are batched until the technique finishes for a frame or super-frame.

The excitation parameterization component (360) also determines (450) whether a pulse codebook is used. The use or non-use of the pulse codebook is indicated as part of an overall coding mode for the current frame, or it may be indicated or determined in other ways. A pulse codebook is a type of fixed codebook that specifies one or more pulses to be contributed to the excitation signal. The pulse codebook parameters include pairs of indices and signs (gains can be positive or negative). Each pair indicates a pulse to be included in the excitation signal, with the index indicating the position of the pulse and the sign indicating the polarity of the pulse. The number of pulses included in the pulse codebook and used to contribute to the excitation signal can vary depending on the coding mode. Additionally, the number of pulses may depend on whether or not an adaptive codebook is being used.

If the pulse codebook is used, then the pulse codebook parameters are optimized (455) to minimize error between the contribution of the indicated pulses and a target signal. If an adaptive codebook is not used, then the target signal is the weighted original signal. If an adaptive codebook is used, then the target signal is the difference between the weighted original signal and the contribution of the adaptive codebook to the weighted synthesized signal. At some point (not shown), the pulse codebook parameters are then signaled in the bit stream.

The excitation parameterization component (360) also determines (465) whether any random fixed codebook stages are to be used. The number (if any) of the random codebook stages is indicated as part of an overall coding mode for the current frame, or it may be indicated or determined in other ways. A random codebook is a type of fixed codebook that uses a pre-defined signal model for the values it encodes. The codebook parameters may include the starting point for an indicated segment of the signal model and a sign that can be positive or negative. The length or range of the indicated segment is typically fixed and is therefore not typically signaled, but alternatively a length or extent of the indicated segment is signaled. A gain is multiplied by the values in the indicated segment to produce the contribution of the random codebook to the excitation signal.

If at least one random codebook stage is used, then the codebook stage parameters for that codebook stage are optimized (470) to minimize the error between the contribution of the random codebook stage and a target signal. The target signal is the difference between the weighted original signal and the sum of the contribution to the weighted synthesized signal of the adaptive codebook (if any), the pulse codebook (if any), and the previously determined random codebook stages (if any). At some point (not shown), the random codebook parameters are then signaled in the bit stream.

The component (360) then determines (480) whether any more random codebook stages are to be used. If so, then the parameters of the next random codebook stage are optimized (470) and signaled as described above. This continues until all the parameters for the random codebook stages have been determined. All the random codebook stages can use the same signal model, although they will likely indicate different segments from the model and have different gain values. Alternatively, different signal models can be used for different random codebook stages.

Each excitation gain may be quantized independently or two or more gains may be quantized together, as determined by the rate controller and/or other components.

While a particular order has been set forth herein for optimizing the various codebook parameters, other orders and optimization techniques may be used. For example, all random codebooks could be optimized simultaneously. Thus, although FIG. 4 shows sequential computation of different codebook parameters, alternatively, two or more different codebook parameters are jointly optimized (e.g., by jointly varying the parameters and evaluating results according to some non-linear optimization technique). Additionally, other configurations of codebooks or other excitation signal parameters could be used.

The excitation signal in this implementation is the sum of any contributions of the adaptive codebook, the pulse codebook, and the random codebook stage(s). Alternatively, the component (360) may compute other and/or additional parameters for the excitation signal.

Referring to FIG. 3, codebook parameters for the excitation signal are signaled or otherwise provided to a local decoder (365) (enclosed by dashed lines in FIG. 3) as well as to the frame output (392). Thus, the encoded frame output (392) includes the output from the LPC processing component (335) discussed above, as well as the output from the excitation parameterization component (360).

The bit rate of the output (392) depends in part on the parameters used by the codebooks, and the encoder (300) may control bit rate and/or quality by switching between different sets of codebook indices, using embedded codes, or using other techniques. Different combinations of the codebook types and stages can yield different encoding modes for different frames and/or sub-frames. For example, an unvoiced frame may use only one random codebook stage. An adaptive codebook and a pulse codebook may be used for a low rate voiced frame. A high rate frame may be encoded using an adaptive codebook, a pulse codebook, and one or more random codebook stages. The rate control module can determine or influence the mode for each frame.

Referring still to FIG. 3, the output of the excitation parameterization component (360) is received by codebook reconstruction components (370, 372, 374, 376) and gain application components (380, 382, 384, 386) corresponding to the codebooks used by the parameterization component (360). The codebook stages (370, 372, 374, 376) and corresponding gain application components (380, 382, 384, 386) reconstruct the contributions of the codebooks. Those contributions are summed to produce an excitation signal (390), which is received by the synthesis filter (340), where it is used together with the "predicted" samples from which subsequent linear prediction occurs. Delayed portions of the excitation signal are also used as an excitation history signal by the adaptive codebook reconstruction component (370) to reconstruct subsequent adaptive codebook parameters (e.g., pitch contribution), and by the parameterization component (360) in computing subsequent adaptive codebook parameters (e.g., pitch index and pitch gain values).

Referring back to FIG. 2, the encoded frame output is accepted by the MUX (236), along with other parameters. Such other parameters can include, among other information, frame class information (222) from the frame classifier (214) and frame encoding modes. The MUX (236) constructs application layer packets to pass to other software, or the MUX (236) puts data in the payloads of packets that follow a protocol such as RTP. The MUX may buffer parameters so as to allow selective repetition of the parameters for forward error correction in later packets. In one implementation, the MUX (236) packs into a single packet the primary encoded speech information for one frame, along with forward error correction information for all or part of one or more previous frames.

The MUX (236) provides feedback such as current buffer fullness for rate control purposes. More generally, various components of the encoder (230) (including the frame classifier (214) and MUX (236)) may provide information to a rate controller (220) such as the one shown in FIG. 2.

The bit stream DEMUX (276) of FIG. 2 accepts encoded speech information as input and parses it to identify and process parameters. The parameters may include frame class, some representation of LPC values, and codebook parameters. The frame class may indicate which other parameters are present for a given frame. More generally, the DEMUX (276) uses the protocols used by the encoder (230) and extracts the parameters the encoder (230) packs into packets. For packets received over a dynamic packet-switched network, the DEMUX (276) includes a jitter buffer to smooth out short term fluctuations in packet rate over a given period of time. In some cases, the decoder (270) regulates buffer delay and manages when packets are read out from the buffer so as to integrate delay, quality control, concealment of missing frames, etc. into decoding. In other cases, an application layer component manages the jitter buffer, and the jitter buffer is filled at a variable rate and depleted by the decoder (270) at a constant or relatively constant rate.

The DEMUX (276) may receive multiple versions of parameters for a given segment, including a primary encoded version and one or more secondary error correction versions. When error correction fails, the decoder (270) uses concealment techniques such as the concealment techniques described below.

Figure 5:
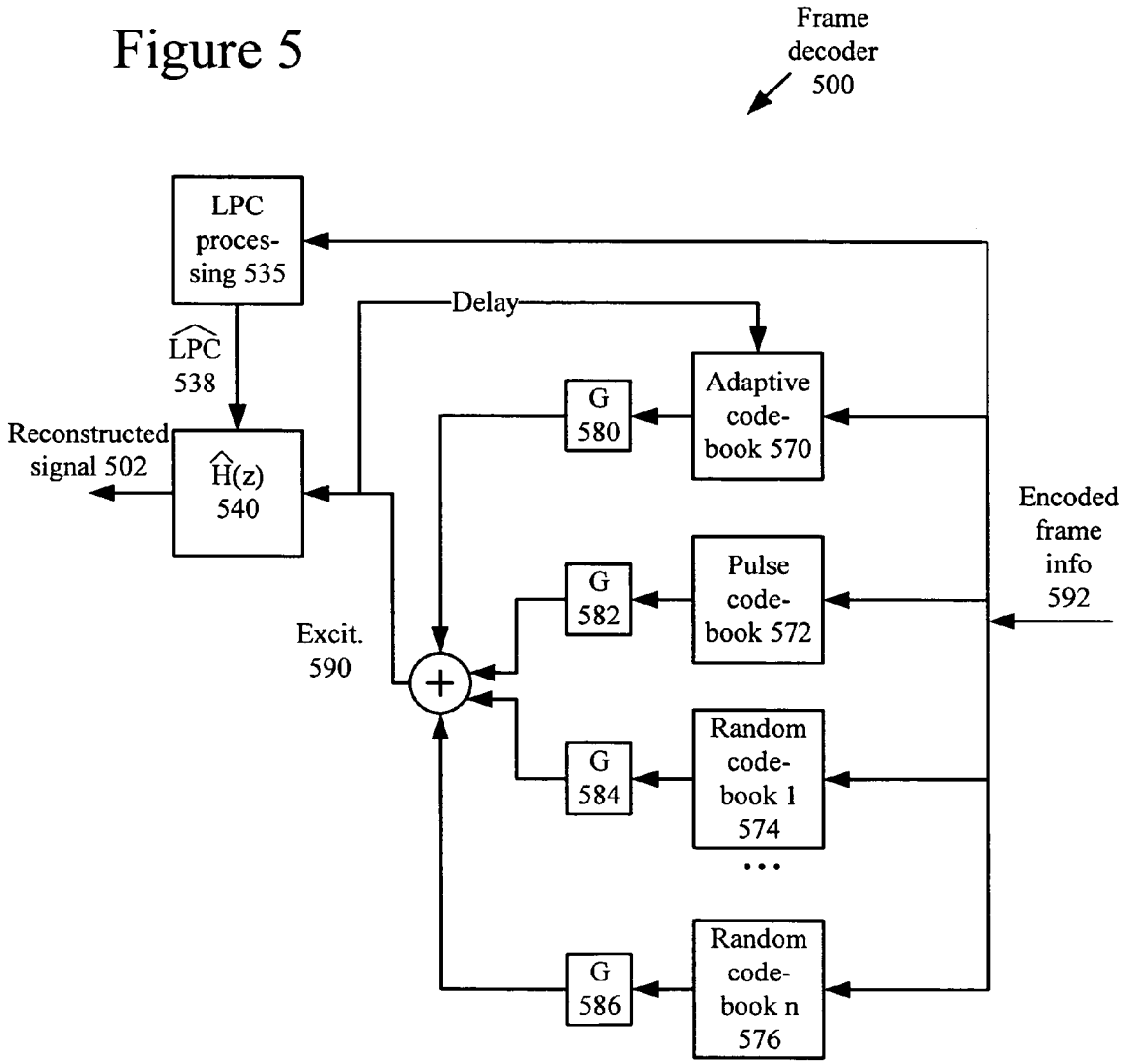
FIG. 5 is a block diagram of a real-time speech frame decoder in conjunction with which one or more of the described embodiments may be implemented.

FIG. 5 is a block diagram of a generalized real-time speech frame decoder (500) in conjunction with which one or more described embodiments may be implemented. The frame decoder (500) corresponds generally to the framedecoding component (272) of FIG. 2.

The frame decoder (500) accepts encoded speech information (592) as input and produces a reconstructed output (502) after decoding. The components of the decoder (500) have corresponding components in the encoder (300), but overall the decoder (500) is simpler since it lacks components for perceptual weighting, the excitation processing loop and rate control.

The LPC processing component (535) receives information representing LPC values in the form provided by the frame encoder (300) (as well as any quantization parameters and other information needed for reconstruction). The LPC processing component (535) reconstructs the LPC values (538) using the inverse of the conversion, quantization, encoding, etc. previously applied to the LPC values. The LPC processing component (535) may also perform interpolation for LPC values (in LPC representation or another representation such as LSP) to smooth the transitions between different sets of LPC coefficients.

The codebook stages (570, 572, 574, 576) and gain application components (580, 582, 584, 586) decode the parameters of any of the corresponding codebook stages used for the excitation signal and compute the contribution of each codebook stage that is used. More generally, the configuration and operations of the codebook stages (570, 572, 574, 576) and gain components (580, 582, 584, 586) correspond to the configuration and operations of the codebook stages (370, 372, 374, 376) and gain components (380, 382, 384, 386) in the encoder (300). The contributions of the used codebook stages are summed, and the resulting excitation signal (590) is fed into the synthesis filter (540). Delayed values of the excitation signal (590) are also used as an excitation history by the adaptive codebook (570) in computing the contribution of the adaptive codebook for subsequent portions of the excitation signal.

The synthesis filter (540) accepts reconstructed LPC values (538) and incorporates them into the filter. The synthesis filter (540) stores previously reconstructed samples for processing. The excitation signal (590) is passed through the synthesis filter to form an approximation of the original speech signal.

The relationships shown in FIGS. 2-5 indicate general flows of information; other relationships are not shown for the sake of simplicity. Depending on implementation and the type of compression desired, components can be added, omitted, split into multiple components, combined with other components, and/or replaced with like components. For example, in the environment (200) shown in FIG. 2, the rate controller (220) may be combined with the speech encoder (230). Potential added components include a multimedia encoding (or playback) application that manages the speech encoder (or decoder) as well as other encoders (or decoders) and collects network and decoder condition information, and that performs adaptive error correction functions. In alternative embodiments, different combinations and configurations of components process speech information using the techniques described herein.

III. Robust Decoding Techniques and Tools

With various robust decoding techniques and tools, the quality of speech derived from a speech codec, such as a real-time speech codec, is improved. The various robust decoding techniques and tools may be used separately or in combination.

While particular computing environment features and audio codec features are described above, one or more of the tools and techniques may be used with various different types of computing environments and/or various different types of codecs. For example, one or more of the robust decoder techniques may be used with codecs that do not use the CELP coding model, such as adaptive differential pulse code modulation codecs, transform codecs and/or other types of codecs. As another example, one or more of the robust decoder techniques may be used with single band codecs or sub-band codecs. As another example, one or more of the robust decoder techniques may be applied to a single band of a multi-band codec and/or to a synthesized or unencoded signal including contributions of multiple bands of a multi-band codec.

A. Decoder-Side VoIP

Figure 6:
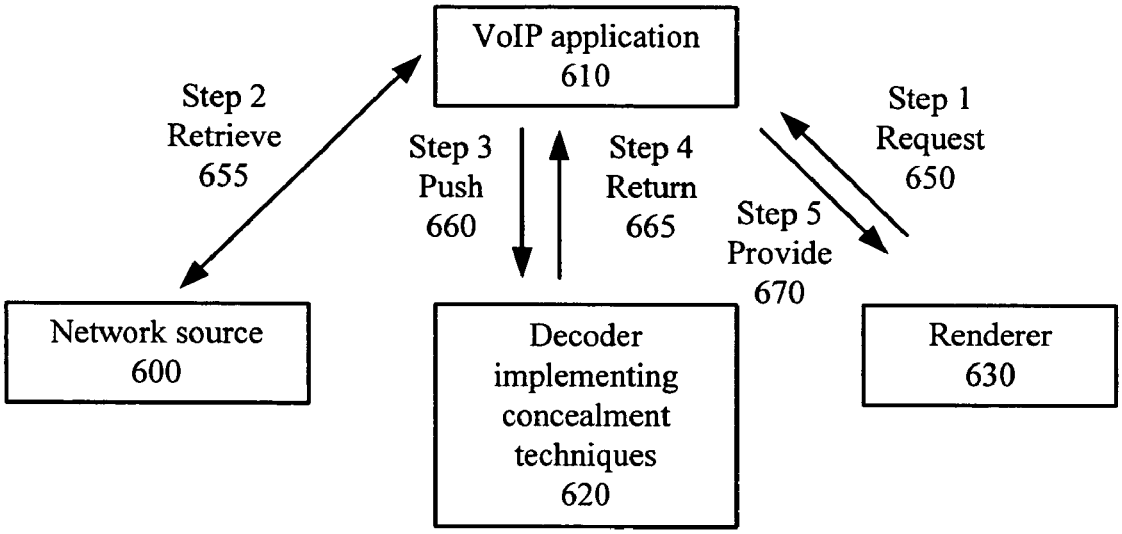
FIG. 6 is a block diagram depicting the general flow of audio information in an example decoder-side VoIP system.

Voice over Internet protocol ("VoIP") applications are one of the possible uses for the described codec. VoIP applications typically operate in either so-called "push mode," or so-called "pull mode." The described techniques may be used in either mode, or in some other mode. However, many of the current VoIP applications use pull-mode decoding. Accordingly, FIG. 6 illustrates in general form one possible arrangement of some decoder-side pull mode operations. In general, the VoIP application (610) passes all packets received from a network source (600) immediately to the decoder (620), which will decide the desired buffering delay. In FIG. 6, the decoder (620) performs the concealment techniques described below, rather than delegating the task of concealment of missing parts of the signal to the receiver application (610). Alternatively, the application (610) or some other component performs the concealment techniques described below.

In pull mode, when the renderer (630), an audio playback component, needs additional decoded audio information to play, it requests (650) the information. The VoIP application (610) retrieves (655) the information available from the network source (600) (not just for the requested playback period) and pushes (660) the information to the decoder (620). The decoder (620) decodes some portion of the information (e.g., samples for the requested playback period) and returns (665) the decoded information to the VoIP application (610), which provides (670) the information to the renderer (630).

If one or more frames are missing, the decoder (620) performs one or more concealment techniques and returns the resulting concealment information (e.g., as audio samples) to the VoIP application (610) in place of the actual samples for the missing frame(s). Because the renderer (630) requests samples as it needs them, the timing relies only on the local clock used by the renderer (630). Thus, this design can automatically take care of clock-drift problems that may occur in other designs, such as push-mode decoders that may rely on multiple clocks with slightly different clock rates.

Figure 7:
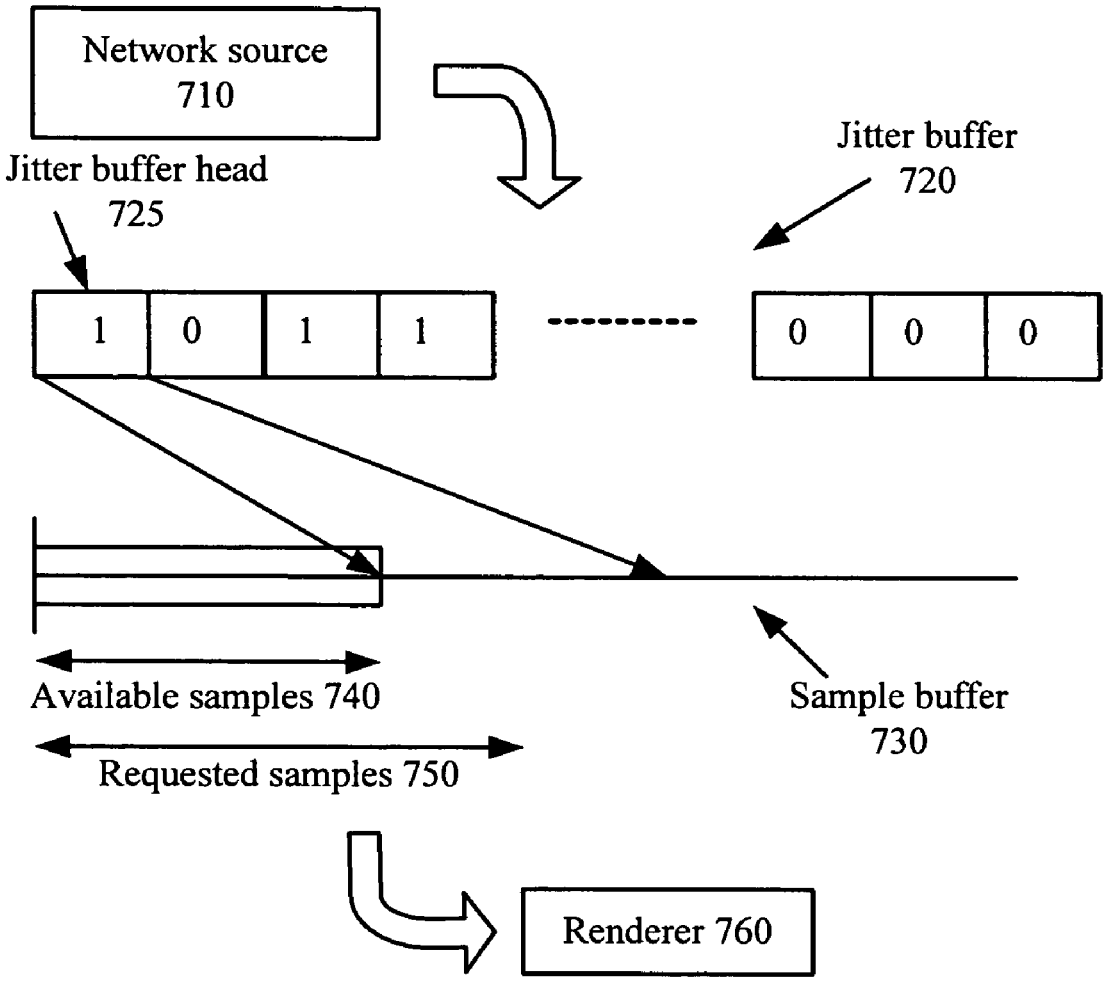
FIG. 7 is a block diagram depicting the buffering of samples in an example decoder-side buffering technique.

As illustrated in FIG. 7, the packets received by the VoIP application from a network source (710) are delivered immediately into the decoder, which places them according to their sequential order (in the audio signal) in a jitter buffer (720). As illustrated in FIG. 7, a "1" in the jitter buffer (720) indicates that a corresponding packet is present, and a "0" indicates that the corresponding packet is absent.

In addition, there is a sample buffer (730), which holds decoded output samples (740) available for playback. Whenever the renderer (760) wants to play some audio, it pulls from the decoder sample buffer (730) the desired samples (750). If the sample buffer (730) does not have enough samples to satisfy the request, the decoder looks to the jitter buffer (720) to see if the next packet is available.

If the next packet is available, then it is decoded, and the decoded samples are placed in the sample buffer (730), and the requested samples are passed to the renderer (760) through the VoIP application. On the other hand, if the packet is not available, then a concealment module is invoked to generate replacement samples. The replacement samples are placed in the sample buffer (730), and the request is satisfied. In either case, the jitter buffer can be shifted, and the jitter buffer head information (725) is appropriately adjusted.

B. Packet Delay Calculation

Figure 8:
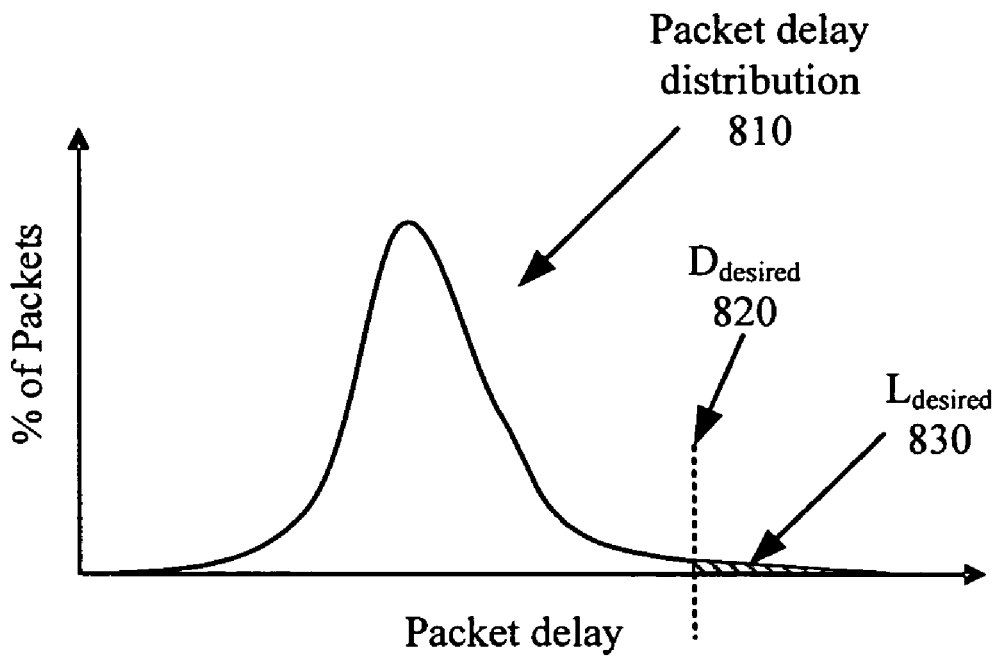
FIG. 8 is a graph of an example packet delay distribution.

In some robust decoding techniques and tools, the decoder tracks the packet loss rate and estimates the network delay by monitoring the packet receiving times. FIG. 8 illustrates an example packet delay distribution. The history of received packets can be used to determine any delay trends, and to calculate a desired delay ($D_{desired}$, 820). If the desired delay (820) changes or if the packet delay distribution changes (e.g., due to network fluctuations), the decoder can change the jitter buffer delay dynamically and decode using time compression/extension (or variable-playout) techniques, which modifies the playback time of audio while maintaining the correct pitch. Using such techniques, when it is observed that the packet delay is increasing, the samples in the sample buffer can be time-extended so that the late packets can be accommodated up to a certain point acceptable for playback delay, interactivity, etc. For voiced frames, this can be done using the WSOLA techniques described below. Similarly, if the delay is observed to be decreasing, then the samples in the sample buffer can be time-compressed (played faster), so that the jitter buffer does not become full.

Traditional approaches to calculating the desired delay include simply using the maximum delay of previous packets as a guide. However, sometimes outliers may exist, causing the system to adapt to unrepresentative packet delay values. In addition, it is sometimes better to let a few packets arrive too late to be played back than to impose a delay long enough to receive and use the outlier, late packets. Some codecs calculate desired delay based on formulas such as running averages and running variance calculations. One example is described in R. Ramjee, J. Kurose, D. Towsley, and H. Schulzrinne, "Adaptive Playout Mechanisms for Packetized Audio Applications in Wide-area Networks," *Proceedings of IEEE INFOCOM* '94, pp. 680-688, April 1994. However, many parameters need to be optimized in such calculations, and it is difficult to find the right tradeoff between response speed on the one hand, and basing the calculations on a representative population of history values on the other hand.

Another approach is to directly analyze a packet delay distribution (810), such as by using the implementation of the Concord algorithm described in C. J. Sreenan, J-C. Chen, P. Agrawal, and B. Narendran, "Delay Reduction Techniques for Playout Buffering," *Proc. IEEE Trans. Multimedia*, vol. 2, no. 2, pp. 88-100, June 2000. In that method, a histogram of packet delays is maintained. The width of a bin in the histogram represents the desired accuracy with which the optimal delay will be calculated. Decreasing the bin size improves the accuracy but increases tracking complexity. The shape of the histogram approximately mirrors the underlying packet delay distribution. When a new packet arrives, the packet delay is mapped to the corresponding bin and the count of the packets that fall into that bin is incremented. To reflect the age of some old packets, counts in all other bins are scaled down in a process called "aging." To find the new desired delay the decoder sets a desired loss rate ($L_{desired}$, 830). Typical desired loss rate values range between 1% and 5%. The histogram is then analyzed to determine where the desired delay needs to be to achieve the loss rate. The problem with this approach is that some parameters need to be tuned, such as bin width and aging factors. In addition, all old packets are treated similarly, and the aging approach plays an overly significant role in the overall performance. In addition, when a clock-drift situation occurs, the overall delay has either a positive or a negative trend, which can further complicate the algorithm, especially when the histogram is meant to stay static within the time delay timeline.

In one robust decoding technique presented herein, a history of delays for a set number of packets is maintained. For, example the number of packets included in the history may be 500, 1000 or some other suitable number. With each incoming packet, the delay of the oldest packet is replaced with the delay of the newest packet, or the oldest packet is otherwise replaced with the newest packet in the history. That way, only the oldest packet is removed from the calculations. Referring to FIG. 8, a packet delay distribution histogram (810) is generated according to a desired bin width based on the history of all packet delays on record. The optimal desired delay (820) is determined to be the bin delay value corresponding to the desired loss (830). This technique does not rely on aging methods. Accordingly, problems resulting from clock-drift situations are decreased. However, the computational requirements to regenerate a new histogram with each new packet are typically high. For example, in one implementation, the histogram computation consumed about 10% of the overall decoder complexity. It may be possible to decrease this complexity by reusing a previous histogram, rather than rebuilding it from scratch, but if the clock-drift situation occurs, this could allow the delay histogram to shift along the delay time axis even when it should remain static.

In another robust decoding technique, a data structure is used to determine the optimal buffering delay that is adapted to varying packet delays. In a particular implementation, a doubly-linked list of delay nodes placed linearly in memory (e.g., in an array) is used for updates, as well as for determining the desired delay. The history at the nth packet received is defined by History[n]={$D_n$, $D_{n-1}$, $D_{n-2}$, . . . , $D_{n-N+1}$} where the size of the history is N packets. The delay values for the packets represented in the history are placed in a doubly-linked list type of data structure.

Figure 9:
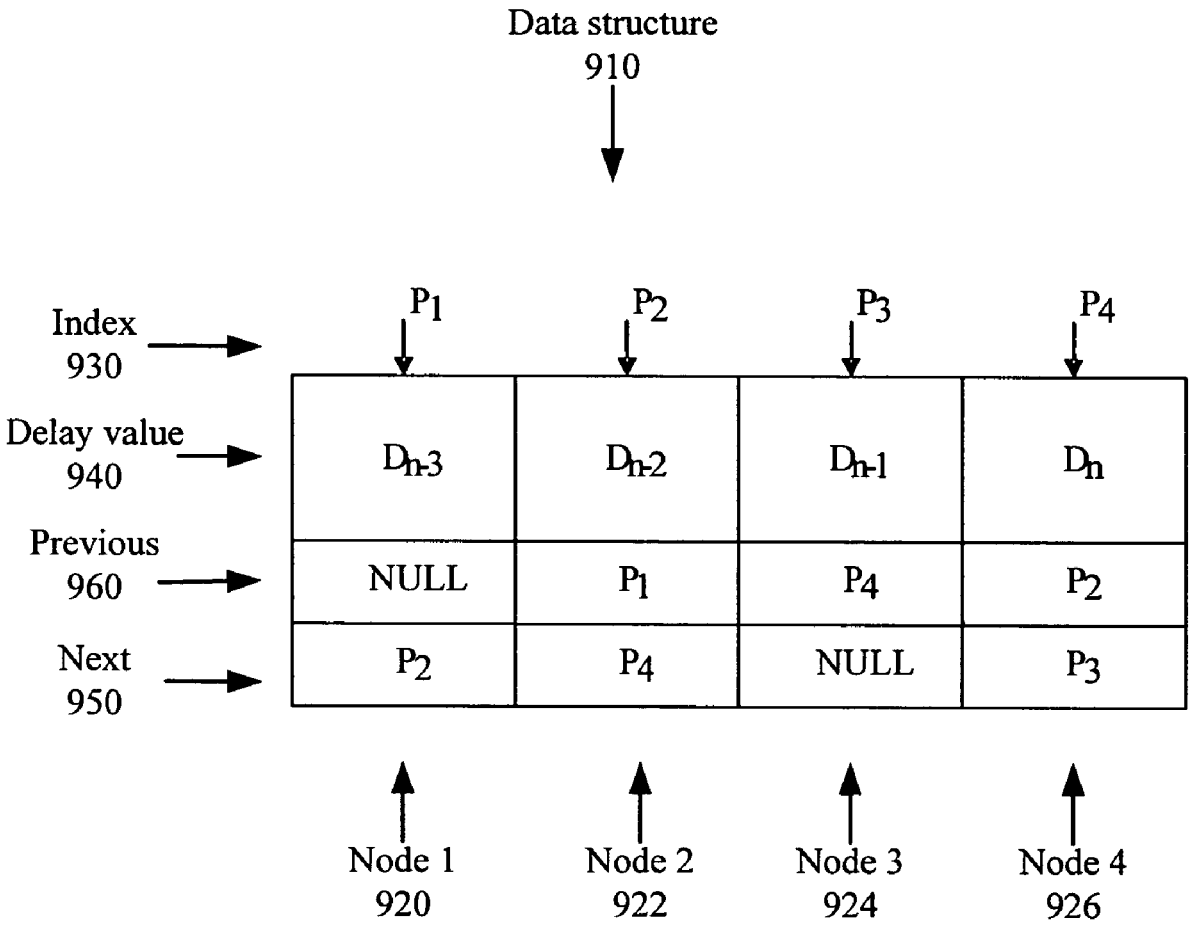
FIG. 9 is a diagram of an example packet delay data structure.

An example of such a data structure (910) with four nodes (920, 922, 924, 926) in an array is illustrated in FIG. 9. Of course, the data structure can include many more nodes, such as 500 to 1000 nodes. However, four nodes are shown for the sake of simplicity in explaining the data structure. Each node includes a delay value (940) that corresponds to the delay of a received packet. The nodes (920, 922, 924, 926) may be placed linearly in memory, and an index P (930) can be cycled over all the nodes. Thus, the index P (1030) tracks the packet that is currently the oldest in the array. Each node (920, 922, 924, 926) has a next pointer (950) (here, simply a field of a node) and a previous pointer (960) (here, simply a field of a node). Each next pointer (950) references the node with the next higher delay value. Each previous pointer (960) references the node with the next lower delay value. Thus, in the data structure (910) illustrated in FIG. 9, $D_{n-1}$ (at $P_3$)>$D_n$ (at $P_4$)>$D_{n-2}$ (at $P_2$)>$D_{n-3}$ (at $P_1$). The oldest packet ($P_1$) is at the start of the list initially.

When each new packet is received, the packet is added to the structure (910) up to the point that the history is filled (e.g., 500 packets tracked). At that point, when a new packet is received, the node including information about the oldest packet is replaced (e.g., packet 1 is replaced with packet 501 and the oldest packet is now packet 2, then packet 2 is replaced with packet 502 and the oldest packet is now packet 3). When the old node information is replaced, the previous and next pointers are updated. For the new delay value, the right place in the ordered list of delay values is found by looping over the next pointers and then the delay value is "inserted" in the ordering of delay values by updating the next and previous pointers.

The linked list also maintains a reference to the highest delay in the list. When it is desired to find the optimal desired delay for a corresponding desired loss rate, a decoder starts at the highest delay and follows the previous pointers towards lower delays until a count of nodes corresponding to the desired loss rate is found. This can be done each time a new packet is received, or at some other interval. Thus, finding the desired delay is a simple process because only a few nodes (for example 1% to 5% for 1% to 5% desired loss values) are traversed. Also, this can provide a natural solution to the clock-drift problem because no actual histograms are formed. Thus, the phenomenon of shifting histograms can be automatically handled. Additionally, the calculations are not confined to the accuracy specified by bin-widths. Accordingly, the calculations can be finer and more accurate than with typical histogram techniques.

Alternatively, instead of being implemented as an array in linear memory, the doubly linked list is implemented as some other type of dynamic data structure.

C. Signal-Dependent Concealment

When one or more packets are missing, one of several different approaches can be used to produce a signal that conceals the loss. An appropriate concealment technique can be chosen depending on the nature of the signal and the number of missing packets or frames.

Figure 10:
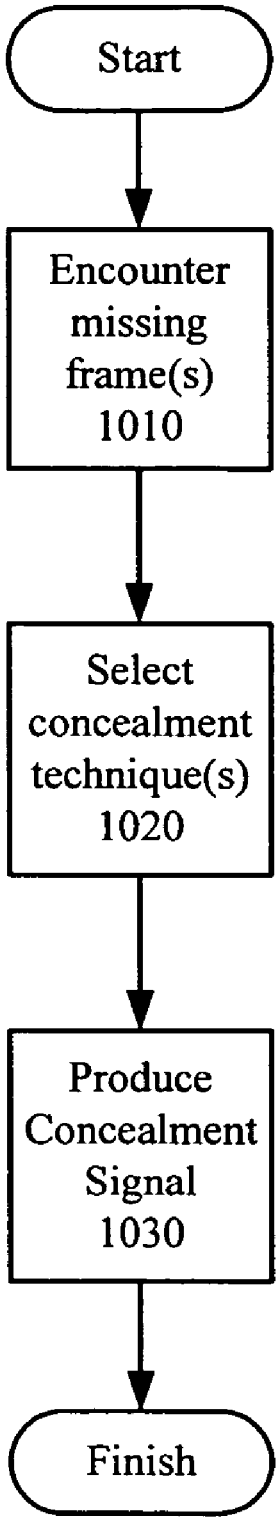
FIG. 10 is a flow diagram depicting an example of determining an appropriate concealment technique.

One example of a signal technique determination is illustrated in FIG. 10. Alternatively other determinations are used. Referring to FIG. 10, one or more missing frames is encountered (1010). A concealment technique is selected (1020) based on one or more factors such as the nature of one or more adjacent frame(s) and the number of missing frames. Alternatively, other and/or additional factors are used for the selection. A concealment signal is produced (1030) using the selected technique. Several example signal-dependent concealment techniques follow. According to a first type of signal-dependent concealment technique, unidirectional concealment of voiced speech is used when past information is available for a missing voiced frame or frames and the preceding available frame is classified as a voiced frame. Unidirectional concealment may also be used, when future information is available, if the gap between available audio information is too long to practically use bi-directional concealment or to maintain low complexity, or for other reasons.

The waveform similarity overlap-add concealment technique ("WSOLA") can be used for unidirectional concealment. WSOLA is described in Y. J. Liang, N. Farber, and B. Girod, "Adaptive Playout Scheduling and Loss Concealment for Voice Communication over IP Networks," *IEEE Transactions on Multimedia*, vol. 5, no. 4, pp. 532-543, December 2003. The WSOLA technique extends a previous signal by generating new pitch cycles through weighted averages of existing pitch cycles. Any desired length can be generated using this method until the next packet is received. However, if the pitch extension becomes too excessive, such as where many packets are lost, the WSOLA method can result in a mechanical sound.

Thus, in the present robust decoding technique, noise may be added if the pitch extension becomes too excessive. The noise can be generated, for example, using random white noise passed through a linear prediction coefficient filter optimized for the latest received audio signal. The energy of the noise can increase as the extension increases. As discussed below, the energy of the pitch extensions can also gradually decrease until all that remains is the generated background noise.

The extended signal is merged with a later signal produced from a later-received packet. This can include a signal matching routine to maximize the correlation between the two signals. That signal matching routine can be a simple correlation routine, such as a correlation routine that multiplies corresponding sample amplitudes for the overlapping signals and sums the resulting products to produce a correlation value. The lag of the later signal can be adjusted to maximize that correlation value. Alternatively, other signal matching routines can be used. The signals can be merged using weighting windows, such as weighting windows designed to have a constant effect on the signal energy across the merged area.

Figure 11:
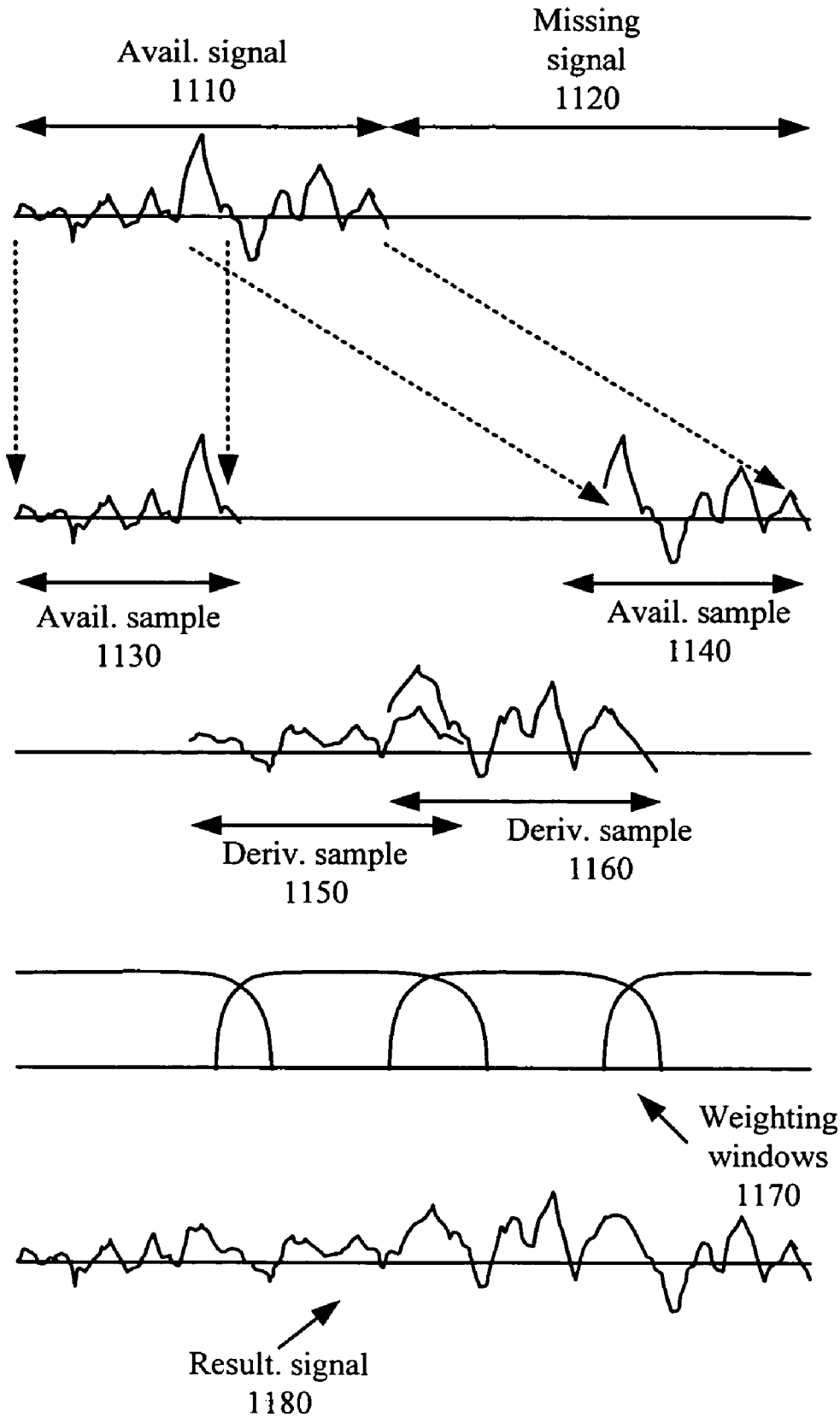
FIG. 11 is a schematic diagram illustrating a technique for concealing missing unvoiced audio information.

According to a second type of signal-dependent concealment technique, if the signal to be extended is unvoiced in nature (i.e., no clear voicing or pitch information can be found in the signal), then a different algorithm is used to extend the signal. In such cases, the signal to be extended is analyzed for the corresponding linear prediction coefficients, and random noise is passed through a linear prediction coefficient filter using those coefficients to generate a synthetic unvoiced signal to be merged with the signal to be extended. The energy of the synthesized signal is derived from the signal used for the extension. In general, this derivation can include breaking a frame of unvoiced speech in half, and extending and merging each half. An example of such a derivation is illustrated in FIG. 11. In the example shown, an unvoiced speech signal (1110) is available for one frame, and a signal (1120) is missing for a subsequent frame. The unvoiced speech signal is broken into two overlapping available sample signals or segments (1130, 1140). The available samples (1130) on the left includes the left half of the available signal (1110) plus a few subsequent samples from the right half for smoothing. For example, forty or eighty subsequent samples can be used. Likewise, the available samples on the right includes the right half of the available signal (1110) plus a few previous samples for smoothing.

Left derived samples (1150) are created based on the energy of the left available samples (1130). Specifically, the left available samples (1130) are analyzed to produce corresponding linear prediction coefficients. Random noise is generated and passed through a linear prediction coefficient filter using those corresponding coefficients. The resulting signal is scaled so that it has a signal energy equal to the signal energy of the available samples (1130), thereby generating a synthetic unvoiced signal, or left derived samples (1150).

Likewise, right derived samples (1160) are created based on the energy of the right available samples (1140). Specifically, the right available samples (1140) are analyzed to produce corresponding linear prediction coefficients. Random noise is generated and passed through a linear prediction coefficient filter using those corresponding coefficients. The resulting signal is scaled so that it has a signal energy equal to the signal energy of the available samples (1140), thereby generating a synthetic unvoiced signal, or right derived samples (1160).

As is illustrated in FIG. 11, the four sets of samples are ordered from left to right as follows: left available samples (1130), left derived samples (1150), right derived samples (1160), and right available samples (1140). The overlapping signals (1130, 1140, 1150, 1160) are merged using weighting windows (1170) to produce a resulting signal (1180). The duration of the resulting signal (1180) is sufficient to cover the play time of the available signal (1110) and the missing signal (1120). The resulting signal (1180) may also be repeated to further extend the signal if subsequent frames are also missing. It is believed that this technique is able to perform well even in many situations where the energy within the available unvoiced frame goes significantly up or down within the frame.

Alternatively, the decoder splits the available information into more segments for derivation, merging, etc.

According to a third type of signal-dependent concealment technique, if both past and future voiced audio information is available, then bi-directional concealment is used. Specifically, if the gap between available audio information is not too long (for example, three missing frames or less), then information from both sides can be used to fill the gap. The past information is extended a bit past the midpoint between past and future available frames, and the future information is extended back a bit past the midpoint. For example, the past and future information may be extended approximately one pitch length past the midpoint for voiced audio, or each may be extended some predetermined fixed amount, such as forty or eighty samples past the midpoint. One or both of the signals can be extended using the WSOLA method, the unvoiced concealment technique described above, and/or some other method. For example, if the past information is voiced and the future information is unvoiced, then the first technique described above can be used to extend the past information and the second technique can be used to extend the future information. For voiced signals, a signal matching routine such as the one described above can be used to make sure that the signals are merged at the best location at the past and future ends and the midpoint. Whether the signals are voiced, unvoiced, or both, the signals can then be merged using weighting windows, such as weighting windows designed to keep the signal energy approximately constant in the merged area. Noise is typically not added to the signal when such bi-directional concealment is used.

In the first or second preceding type of signal-dependent concealment techniques, when there is an extended period with no received packets, the energy of the extended voiced or unvoiced signal created using one of the techniques described above is gradually decreased, and generated background noise is gradually increased until the resulting signal reaches a previously-determined energy level of background noise. This helps to reduce the artificial sounds such as ringing and mechanical sounds that can result from signals being extended for long periods of time. This technique can be particularly useful in applications that use voice-activity detection without any comfort noise generation. In such applications, when voice activity stops (e.g., pauses between sentences, or while the other talker is speaking), the sender application simply stops sending packets for the silence period. In such a case, although the decoder may encounter missing frames for such periods, the decoder can revert to background noise, which is the desired response during silence periods. In one implementation, noise begins to be gradually introduced after the signal has been extended for about two frames and the noise typically becomes perceptible to a listener after about four frames. By the time the signal has been extended for about six or seven frames, only background noise remains. These times can be adjusted based on the perceived audio quality to listeners in different circumstances.

D. Pitch Jittering

Using the WSOLA technique or other voiced speech extension techniques, a signal can be produced using the pitch characteristics of a previous signal segment, such as a previous frame or frames. The resulting signal segment is often reused to extend the signal, sometimes to conceal the loss of many packets. Such repeated extension of a signal through pitch repetition (such as using the WSOLA technique) can result in ringing or mechanical sounds. The weighting used in the WSOLA technique itself can help to reduce such effects. Noise addition techniques such as those described above can further reduce such effects.

Ringing or mechanical sounds can also be reduced by adding a random, pseudorandom, or other adjustment factor to the pitch size/offset in subsequent samples as the signal is extended. Accordingly, instead of extending the signal in exact-size pitch cycles, a factor is added to the pitch size so that the signal more closely resembles natural speech, which rarely has an exactly fixed pitch rate. As the length of the extension increases, the factor may be increased in magnitude.

This technique can be implemented by using a factor table or list that includes a sequence of factors, with the range of the factors gradually increasing in magnitude. As an example, the offset adjustment factor may be zero samples for the first pitch cycle, negative one for the second cycle, positive one for the third pitch cycle, positive two for the fourth cycle, negative one for the fifth cycle, etc. Or, the adjustment factor may be selected randomly/pseudorandomly from the applicable range during decoding. In one implementation, the maximum range of the random factors is from negative three samples to positive three samples. However, the magnitude of the range may be adjusted based on listening tests. Alternatively, other techniques may be used to produce the adjustment factors and/or other ranges of adjustment factors may be used.

The three techniques described above to reduce the undesirable sound effects from repeating pitch cycles (WSOLA weighting, noise addition, and pitch jittering) can be used separately or in combination. Repeated tuning of the parameters of these techniques can be done to produce more desirable results in particular implementations.

E. Decoder Memory Recovery

Decoders with limited internal memory or no internal memory are reasonably simple to use in VoIP applications. In such cases, packet losses do not render the encoder and decoder out-of-sync because there is no significant memory (past history) dependence on previous information when decoding current information. However, such voice codecs are usually not very efficient with respect to bit rate. In codecs where the bit rate is lower, there is typically strong memory dependence introduced in order to improve quality at those lower bit rates. This may not be a problem in some applications, such as compressing for archival purposes. However, when such codecs are used in other applications such as VoIP applications, packets are often lost. Memory dependence, such as memory dependence of the adaptive codebook for producing an excitation signal, can cause extended distortions in the decoder beyond the lost packet.

Figure 12:
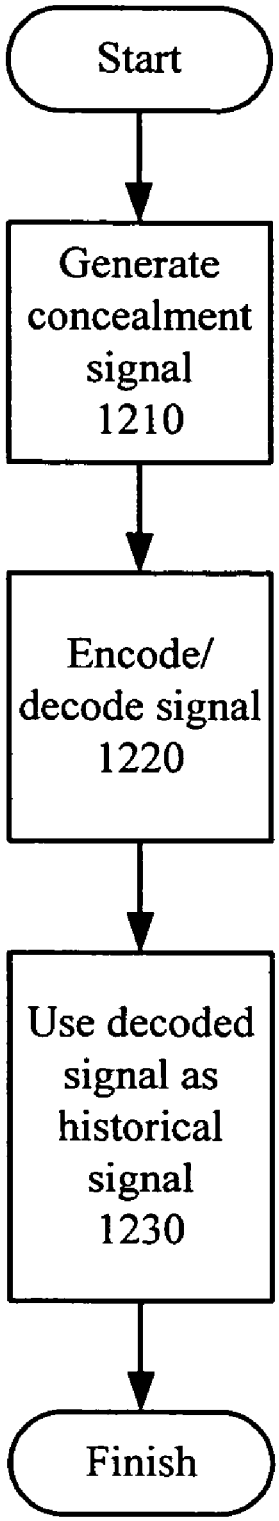
FIG. 12 is a flow diagram depicting an example of a decoder memory recovery technique.

The following technique that can be used to produce substitute information for use as a historical signal by subsequent packets is illustrated generally in FIG. 12. Alternatively, other and/or additional techniques are used.

First, the decoder generates (1210) a concealment signal for one or more missing frames. In this way, the missing frame(s) are concealed up to the part of the signal available from the next received packet. The above signal-dependent techniques can be used for such concealment, for example. Alternatively, other concealment techniques can be used for concealment.

The decoder then performs at least partial encoding (and reconstruction) (1220) on the concealment signal. For example, the decoder passes the concealment signal produced by one or more concealment techniques through a simplified fake encoder (residing in the decoder) to regenerate the decoder internal state. This typically speeds up recovery from missing frame(s) in subsequent decoding.

In a specific implementation, the concealment signal is processed to produce a corresponding residual signal that can be substituted for the missing excitation signal history. This can be done by passing the concealment signal through the inverse of a linear prediction synthesis filter (or in other words a linear prediction analysis filter). In the synthesis filter technique (such as in the component (540) described above) the filter processes a reconstructed residual signal using reconstructed linear prediction coefficients to produce a combined or synthesized signal. In contrast, the linear prediction analysis filter of this technique processes a decoder-generated signal (here the concealment signal) using known linear prediction coefficients to produce a substitute residual signal.

The linear prediction coefficients of the previous frame can be used in the linear prediction analysis filter. Alternatively, new linear prediction coefficients can be calculated by analyzing the concealment signal. This can be done using the techniques described above with reference to the linear prediction analysis component (330). It is believed that better results are achieved by calculating new linear prediction coefficients for the concealment signal. However, it is simpler to use the linear prediction coefficients from the previous frame.

Alternatively, the decoder uses some combination of such linear prediction coefficients, or some other method such as bandwidth expansion.

The signal resulting from this technique can be used by the decoder as the memory for subsequent adaptive codebook computations, in lieu of using the excitation history of the missing frame(s).

Because the concealment signal usually is not perfect, the substitute residual signal produced by the decoder still only approximates the actual memory, or history, that would have been created had the missing frame(s) been decoded. Even so, however, the decoder is able to converge back to the correct state much faster than in circumstances where the excitation history for missing frames is non-existent. Thus, it is believed that this technique can significantly improve quality of the decoded signal following lost packets.

This technique can also be used for the purpose of bi-directional concealment if the next frame following the missing frame(s) has significant memory dependence. In that case, bi-directional concealment can be achieved as follows: first, perform unidirectional concealment for the missing frame(s); second, use that concealment to regenerate an approximate memory for the next frame; third, decode the next frame using the regenerated memory; and fourth, perform bi-directional concealment of the missing frame(s) using the next frame and the frame that precedes the missing frame(s). It is believed that such bi-directional concealment would produce better results than merely using unidirectional concealment or bi-directional concealment with no memory for the next frame.

Having described and illustrated the principles of our invention with reference to described embodiments, it will be recognized that the described embodiments can be modified in arrangement and detail without departing from such principles. It should be understood that the programs, processes, or methods described herein are not related or limited to any particular type of computing environment, unless indicated otherwise. Various types of general purpose or specialized computing environments may be used with or perform operations in accordance with the teachings described herein. Elements of the described embodiments shown in software may be implemented in hardware and vice versa.

In view of the many possible embodiments to which the principles of our invention may be applied, we claim as our invention all such embodiments as may come within the scope and spirit of the following claims and equivalents thereto.

We claim:

1. A method comprising:

at an audio decoder, processing a bit stream for an audio signal, including, when encountering one or more missing frames from the bit stream, then:

identifying one of plural available segments from an available frame;

for the identified available segment of the plural available segments, time-extending the identified available segment, using one or more characteristics of the time-extended identified available segment to adapt a linear prediction coefficient filter in generating noise, and superimposing the generated noise to onto the time-extended available segment to create a derived segment; and forming a merged signal using the plural available segments and the derived segment.

2. The method of claim 1, wherein the one or more characteristics comprise energy of the identified available segment.

3. The method of claim 1, wherein the plural available segments comprise more than two available segments.

4. The method of claim 1, wherein the processing further comprises using the merged signal in place of the available frame and the one or more missing frames.

5. The method of claim 1, wherein the using one or more characteristics of the identified available segment to adapt a linear prediction coefficient filter in generating noise comprises:

passing random noise through the adapted linear prediction coefficient filter to produce the generated noise.

6. A method comprising:

at an audio decoder, processing a bit stream for an audio signal, including, when encountering one or more missing frames from the bit stream, then:

identifying plural available segments by breaking an available frame into the plural available segments;

for at least one of the plural available segments, using one or more characteristics of an available segment to adapt a linear prediction coefficient filter in generating a derived segment by analyzing the available segment to obtain linear prediction coefficients, passing random noise through a linear prediction coefficient filter which is configured according to the obtained coefficients to obtain generated noise, and generating the derived segment by superimposing the generated noise and the available segment; and forming a merged signal by merging the plural derived segments between plural available segments.

7. The method of claim 6, wherein the available frame is an unvoiced frame.

8. The method of claim 7, wherein the one or more characteristics comprise energy of the available segment.

9. The method of claim 6, wherein the plural available segments include first and second available segments, wherein the plural derived segments include first and second derived segments, and wherein forming the merged signal comprises:

merging the first available segment with the first derived segment;

merging the first derived segment with the second derived segment; and merging the second derived segment with the second available segment.

10. The method of claim 6, wherein the plural available segments comprise more than two available segments.

11. The method of claim 6, wherein the plural derived segments comprise more than two derived segments.

12. The method of claim 6, wherein the processing further comprises using the merged signal in place of the available frame and the one or more missing frames.

13. An audio decoder configured to process a bit stream for an audio signal and handle one or more missing frames from the bit stream, the decoder including:

means for identifying plural available segments from an available frame;

means for classifying one or more of the plural available segments as voiced or unvoiced;

means for, for each of the plural available segments, using one or more characteristics of the available segment to adapt a linear prediction coefficient filter in generating a derived segment, wherein the generating the derived segment changes depending on whether the classification of the one or more plural available segments is voiced or unvoiced, wherein the using one or more characteristics of the available segment to adapt a linear prediction coefficient filter in generating a derived segment comprises:

passing random noise through a linear prediction coefficient filter adapted to the available segment, and superimposing the filtered noise onto an extension segment to generate the derived segment; and means for forming a merged signal using the plural available segments and plural derived segments.

14. The decoder of claim 13, wherein the available frame is an unvoiced frame.

15. The decoder of claim 14, wherein the one or more characteristics comprise energy of the available segment.

16. The decoder of claim 13, wherein the plural available segments include first and second available segments, wherein the plural derived segments include first and second derived segments, and wherein forming the merged signal comprises:

merging the first available segment with the first derived segment;

merging the first derived segment with the second derived segment; and merging the second derived segment with the second available segment.

17. The decoder of claim 13, wherein the plural available segments comprise more than two available segments.

18. The decoder of claim 13, wherein the plural derived segments comprise more than two derived segments.

19. The decoder of claim 13, further comprising means for using the merged signal in place of the available frame and the one or more missing frames.

* * * * *